US009555622B2

(12) United States Patent
Yanagisawa

(10) Patent No.: US 9,555,622 B2
(45) Date of Patent: Jan. 31, 2017

(54) PRINTING APPARATUS AND PRINTING METHOD

(71) Applicant: SEIKO EPSON CORPORATION, Tokyo (JP)

(72) Inventor: Koji Yanagisawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/944,725

(22) Filed: Nov. 18, 2015

(65) Prior Publication Data

US 2016/0144614 A1 May 26, 2016

(30) Foreign Application Priority Data

Nov. 20, 2014 (JP) ..... 2014-235897

(51) Int. Cl.

| | |
|---|---|
| ***B41J 2/045*** | (2006.01) |
| ***B41J 2/21*** | (2006.01) |
| ***B41J 19/14*** | (2006.01) |
| *B41J 2/14* | (2006.01) |

(52) U.S. Cl.

CPC ..... *B41J 2/0451* (2013.01); *B41J 2/04581* (2013.01); *B41J 2/2139* (2013.01); *B41J 2/2142* (2013.01); *B41J 19/142* (2013.01); *B41J 2002/14354* (2013.01)

(58) Field of Classification Search

CPC ..... B41J 2/0451; B41J 2/16579; B41J 2/2139; B41J 2/2142

See application file for complete search history.

(56) References Cited

U.S. PATENT DOCUMENTS

| | | | | |
|---|---|---|---|---|
| 6,270,187 | B1 * | 8/2001 | Murcia | B41J 2/0451 347/37 |
| 2004/0165199 | A1 * | 8/2004 | Klassen | H04N 1/6033 358/1.9 |
| 2009/0009543 | A1 * | 1/2009 | Arazaki | B41J 29/393 347/9 |

(Continued)

FOREIGN PATENT DOCUMENTS

| | | | |
|---|---|---|---|
| EP | 2196318 | A1 | 6/2010 |
| JP | 2000-177111 | A | 6/2000 |

OTHER PUBLICATIONS

The Extended European Search Report for the corresponding European Application No. 15195253.8 dated Aug. 5, 2016.

*Primary Examiner* — Geoffrey Mruk
*Assistant Examiner* — Scott A Richmond
(74) *Attorney, Agent, or Firm* — Global IP Counselors, LLP

(57) ABSTRACT

A printing apparatus is configured to perform printing on a recording medium. The printing apparatus includes: droplet discharge heads having nozzles configured to discharge liquids having different colors from each other as droplets onto the recording medium, and an abnormal discharge detecting unit configured to detect an abnormal discharge of the droplets at the respective nozzles. The head unit is capable of taking a mode of performing the printing in the case where the abnormal discharge is detected by the abnormal discharge detecting unit by using, for example, remaining droplet discharge heads except the nozzle that has been detected to have the abnormal discharge and nozzles that discharge droplets having the same color as droplets discharged by the nozzle that has been detected to have the abnormal discharge.

10 Claims, 14 Drawing Sheets

(56) References Cited

U.S. PATENT DOCUMENTS

| | | | | |
|---|---|---|---|---|
| 2012/0075370 | A1 | 3/2012 | Ramakrishnan et al. | |
| 2013/0307896 | A1* | 11/2013 | Shinkawa | B41J 29/393 347/19 |
| 2014/0285584 | A1* | 9/2014 | Mitsuo | B41J 29/38 347/85 |

* cited by examiner

PRINTING APPARATUS AND PRINTING METHOD

BACKGROUND

1. Technical Field

The present invention relates to a printing apparatus and a printing method.

2. Related Art

A printing apparatus configured to perform printing on a sheet-type flexible printing medium by an ink jet system is known (For example, see JP-A-2000-177111). The printing apparatus described in JP-A-2000-177111 includes a print head having a large number of nozzles (printing elements) configured to discharge ink droplets on a recording medium. The printing apparatus described above is configured such that when, for example, a discharge failure of a nozzle occurs due to clogging of the nozzle, printing is performed without using all the nozzles located between the nozzle having the discharge failure and an end of a print head on the side closer to the nozzle having the discharge failure. However, in this case, a state in which many usable nozzles are not used may occur, and depending on the number of the usable nozzles which are not used, a speed of a printing process may be lowered.

SUMMARY

An advantage of some aspects of the invention is to provide a printing apparatus and a printing method which allow continuation of printing while preventing lowering of a speed of a printing process even in the case where an abnormal discharge occurs at a nozzle.

The advantages of the aspects of the invention are achieved by the invention given below.

Application 1

A printing apparatus according to an aspect of the invention is a printing apparatus configured to perform printing on a recording medium. The printing apparatus includes a head unit including a plurality of nozzles that discharge liquids having different colors from each other as droplets onto the recording medium; and an abnormal discharge detecting unit configured to detect an abnormal discharge of the droplets at the respective nozzles. The head unit is capable of taking a mode of performing the printing, in the case where the abnormal discharge is detected by the abnormal discharge detecting unit, by using remaining nozzles except the nozzle that has been detected to have the abnormal discharge and nozzles that discharge droplets having the same color as droplets discharged by the nozzle that has been detected to have the abnormal discharge.

Accordingly, even when the abnormal discharge occurs at the nozzles, the printing can be continued while preventing lowering of a speed of a printing process.

Application 2

In the printing apparatus, preferably, the head unit is capable of multicolor printing with three or more colors and reproduces a color approximate to a color of droplets discharged by the nozzle that has been detected to have the abnormal discharge with droplets discharged by the remaining nozzles.

Accordingly, the color of the droplets discharged from the nozzle that has been detected to have the abnormal discharge can be complemented by a color approximate thereto.

Application 3

In the printing apparatus, preferably, a calibration curve for reproducing the approximate color is stored in advance.

Accordingly, reproduction of the approximate color can be performed as rapidly and accurately as possible.

Application 4

The printing apparatus preferably includes a moving unit configured to alternately perform a primary scanning that moves the head unit in one direction and a secondary scanning that moves the recording medium in a direction intersecting the primary scanning direction, and the head unit includes a plurality of droplet discharge heads for the respective colors of liquid droplets, each of the droplet discharge heads having a plurality of nozzle rows including a plurality of nozzles arranged linearly along the secondary scanning direction. Each of the droplet discharge heads includes the nozzles that discharge droplets of the same color arranged along the secondary scanning direction and the droplet discharge heads are arranged so that the nozzle rows that discharge droplets of different colors arranged in the primary scanning direction.

Accordingly, a plurality of colors of droplets can be applied to a wide range of the recording medium collectively after the droplet discharge heads are moved in a direction orthogonal to a direction of arrangement of the nozzles.

Application 5

In the printing apparatus, preferably, the mode described above is a first mode and a second mode is a mode in which in the case where the abnormal discharge is detected by the abnormal discharge detecting unit, the printing can be performed by using remaining droplet discharge heads except a nozzle row including the nozzle that has been detected to have the abnormal discharge and the droplet discharge heads located in the same primary scanning direction as that of the nozzle row, and the head unit is capable of selecting the first mode or the second mode.

Accordingly, for example, printing that gives a higher priority to the speed of the printing process or printing that gives a higher priority to a quality of a printed image can be performed.

Application 6

In the printing apparatus, preferably, the first mode is selected in the case where the speed of the printing process has higher priority than the quality of the printed image.

Accordingly, the speed of the printing process may reliably have higher priority to the quality of printed image.

Application 7

In the printing apparatus, preferably, in the second mode, by using as a boundary the nozzle row including the nozzle that has been detected to have the abnormal discharge and the nozzle rows located in the same primary scanning direction as the nozzle row, the printing is performed with a plurality of the nozzle rows located on one of the both sides of the boundary in the secondary scanning direction, which has a larger number of the nozzle rows.

Accordingly, the larger number of nozzle rows may be continuously used.

Application 8

In the printing apparatus, preferably, the respective droplet discharge heads have a plurality of the nozzle rows arranged in a zigzag pattern.

Accordingly, for example, a plurality of the nozzle rows may be arranged as tight as possible.

Application 9

In the printing apparatus, preferably, the head unit includes an oscillating plate and a cavity filled with liquid, having an interior pressure increased/decreased by a displacement of the oscillating plate and communicating with the respective nozzles, and is configured to discharge liquid droplets by the increase/decrease of the internal pressure, and the abnormal discharge detecting unit is configured to detect occurrence of the abnormal discharge in accordance with a result of detection of residual oscillations of the oscillating plate.

Accordingly, the abnormal discharge can be detected reliably in such a simple manner as detecting the residual oscillations.

Application 10

A printing method according to an aspect of the invention is a printing method using a printing apparatus including: a head unit having a plurality of nozzles that discharge liquids having different colors from each other as droplets onto a recording medium; and an abnormal discharge detecting unit configured to detect an abnormal discharge of the droplets at the respective nozzles to perform printing on the recording medium. The printing method includes performing printing, in the case where the abnormal discharge is detected by the abnormal discharge detecting unit, by using remaining nozzles except the nozzle that has been detected to have the abnormal discharge and nozzles that discharge droplets having the same color as droplets discharged by the nozzle that has been detected to have the abnormal discharge.

Accordingly, even when the abnormal discharge occurs at the nozzles, the printing can be continued while preventing lowering of a speed of a printing process.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus and a printing method of the invention will be described in detail on the basis of embodiments illustrated in attached drawings.

Figure 1:
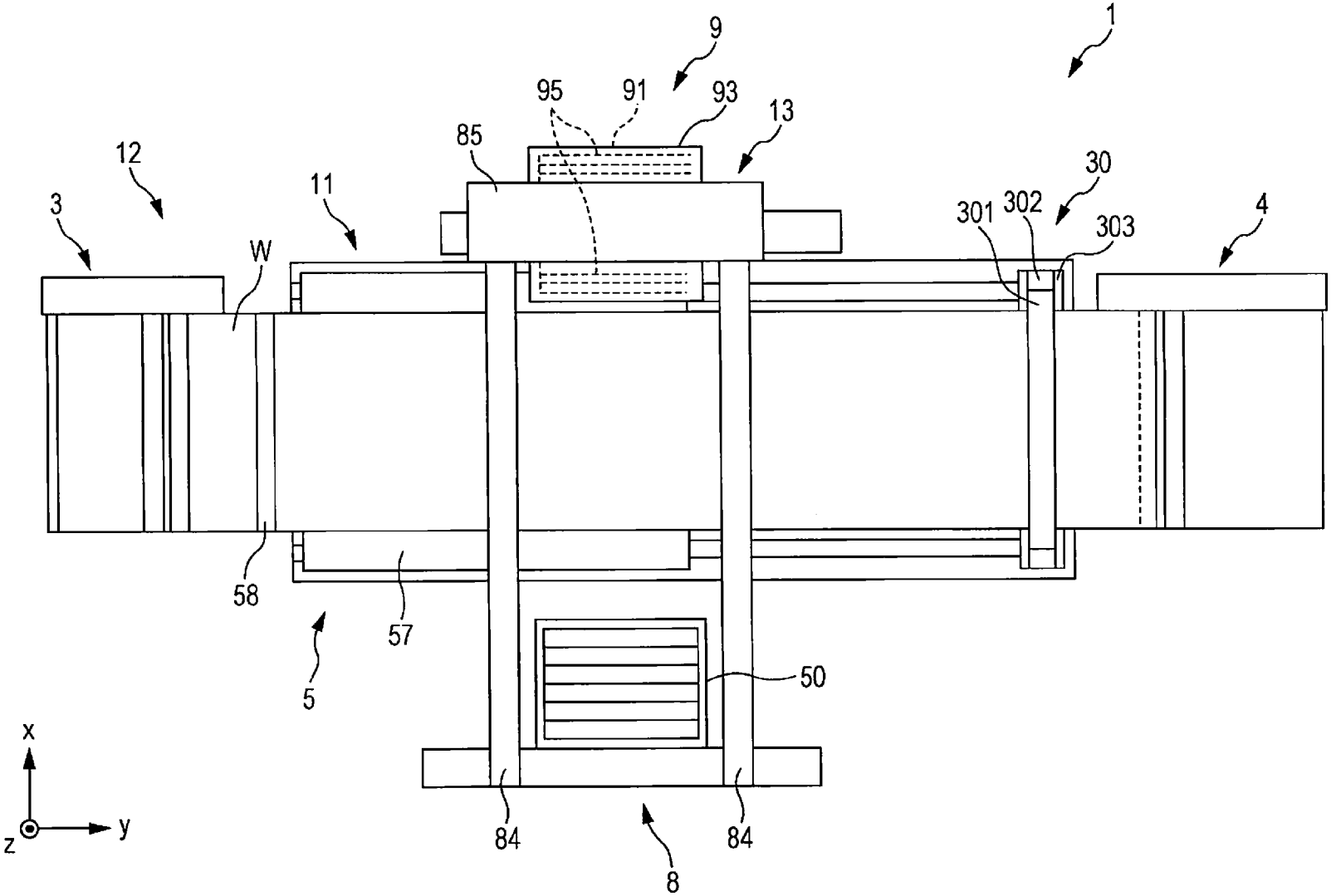
FIG. 1 is a plan view illustrating an embodiment of a printing apparatus of the invention.
Figure 2:
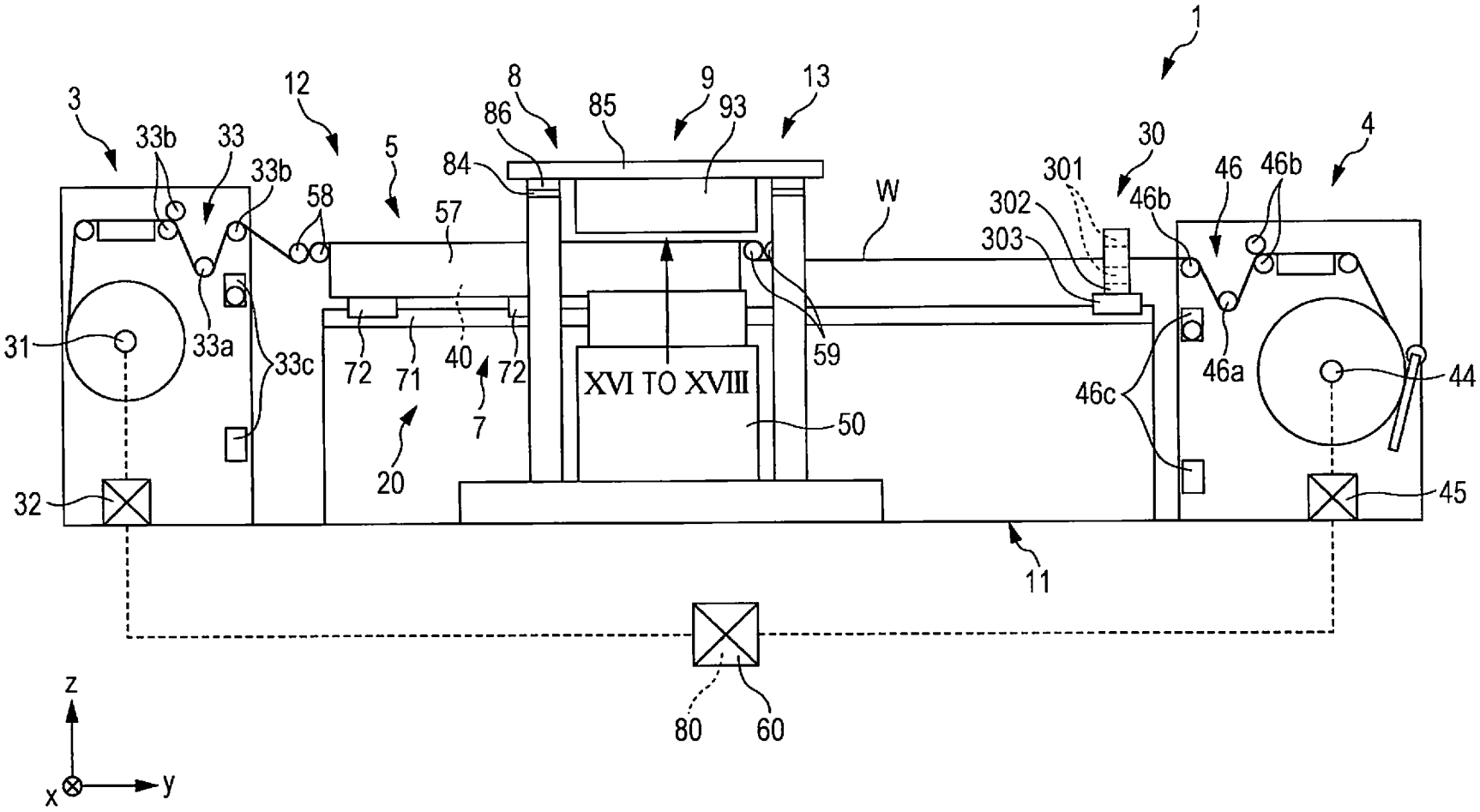
FIG. 2 is a side view of the printing apparatus illustrated in FIG. 1.
Figure 3:
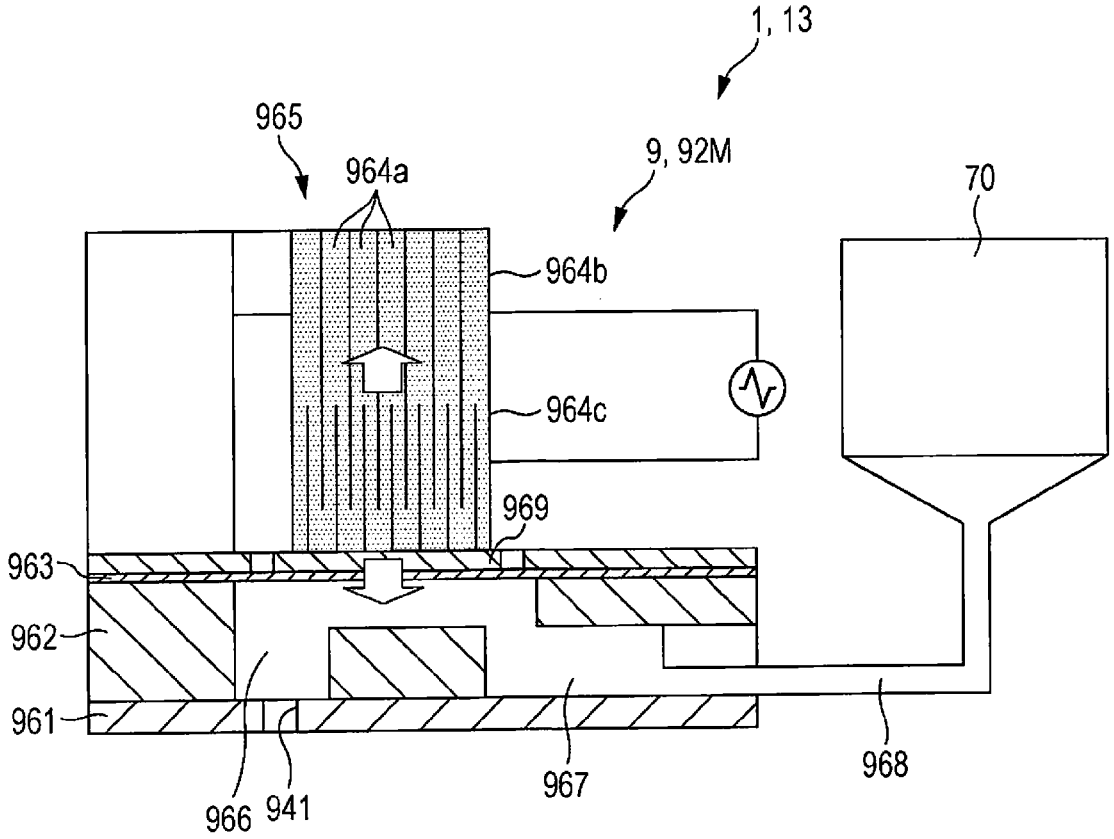
FIG. 3 is a schematic cross-sectional view of a head unit included in the printing apparatus illustrated in FIG. 1.
Figure 13A:
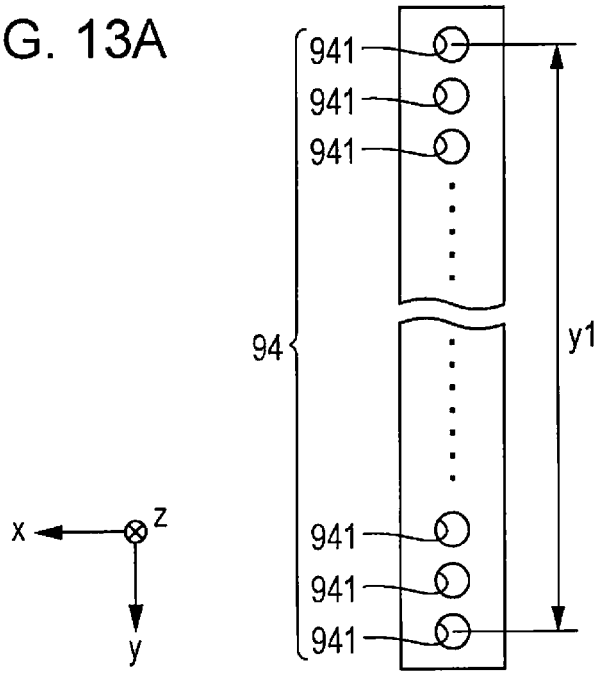
FIGS. 13A and 13B are drawings illustrating a relationship between a length of a nozzle row (see FIG. 13A) and an amount of movement of one stroke of secondary scanning (see FIG. 13B).
Figure 13B:
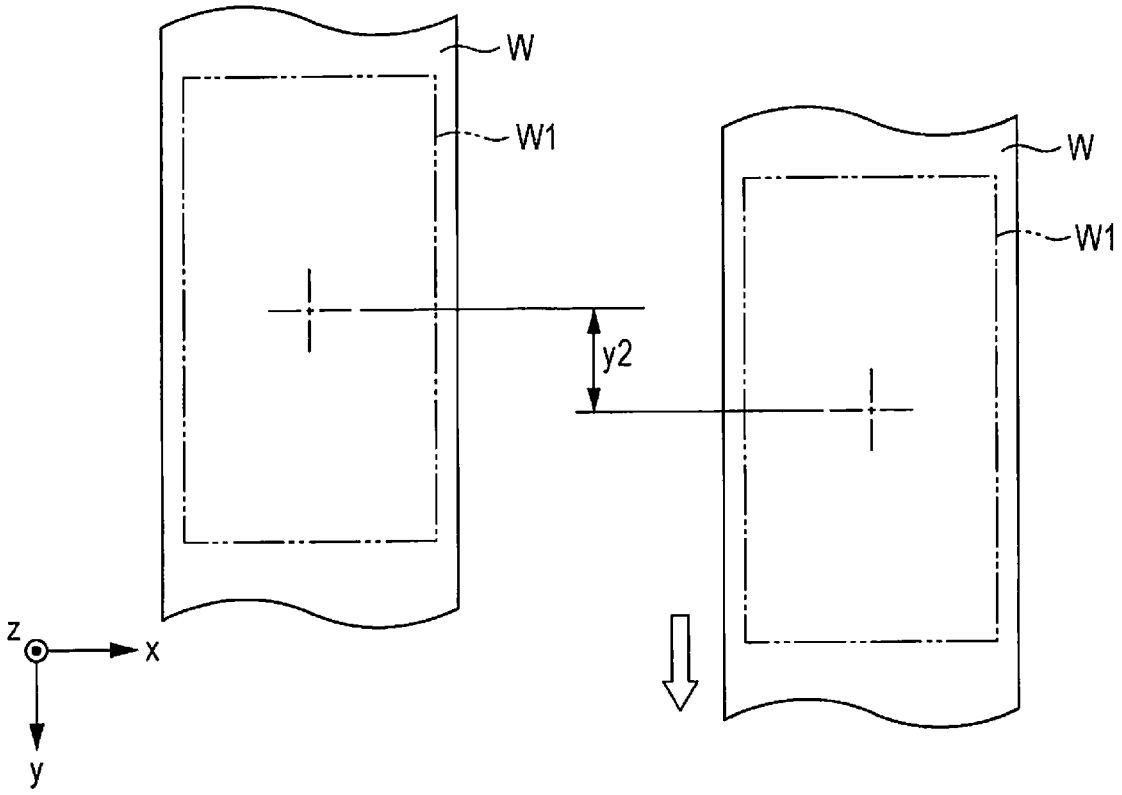
Figure 14:
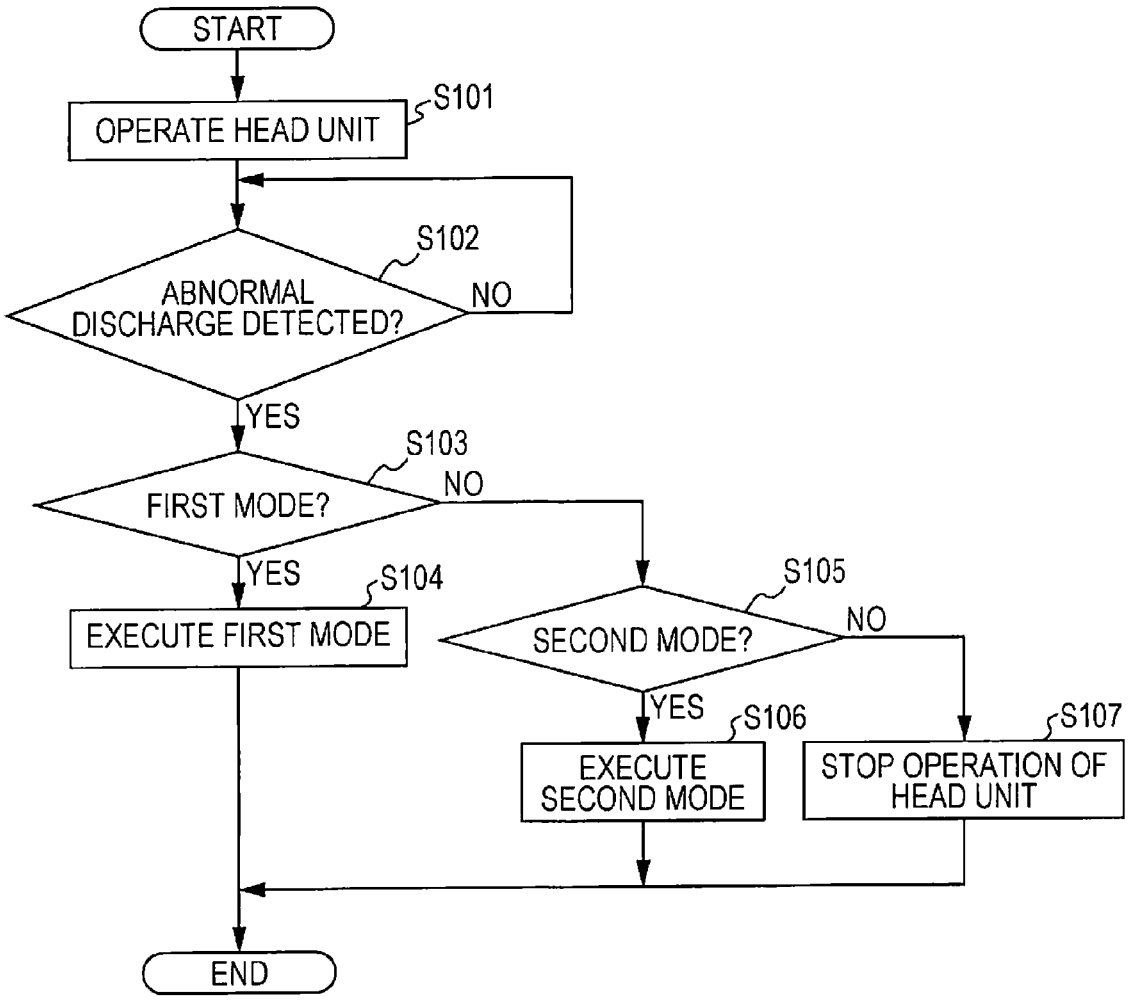
FIG. 14 is a flowchart illustrating a control program of a control unit integrated in the printing apparatus illustrated in FIG. 1.
Figure 15:
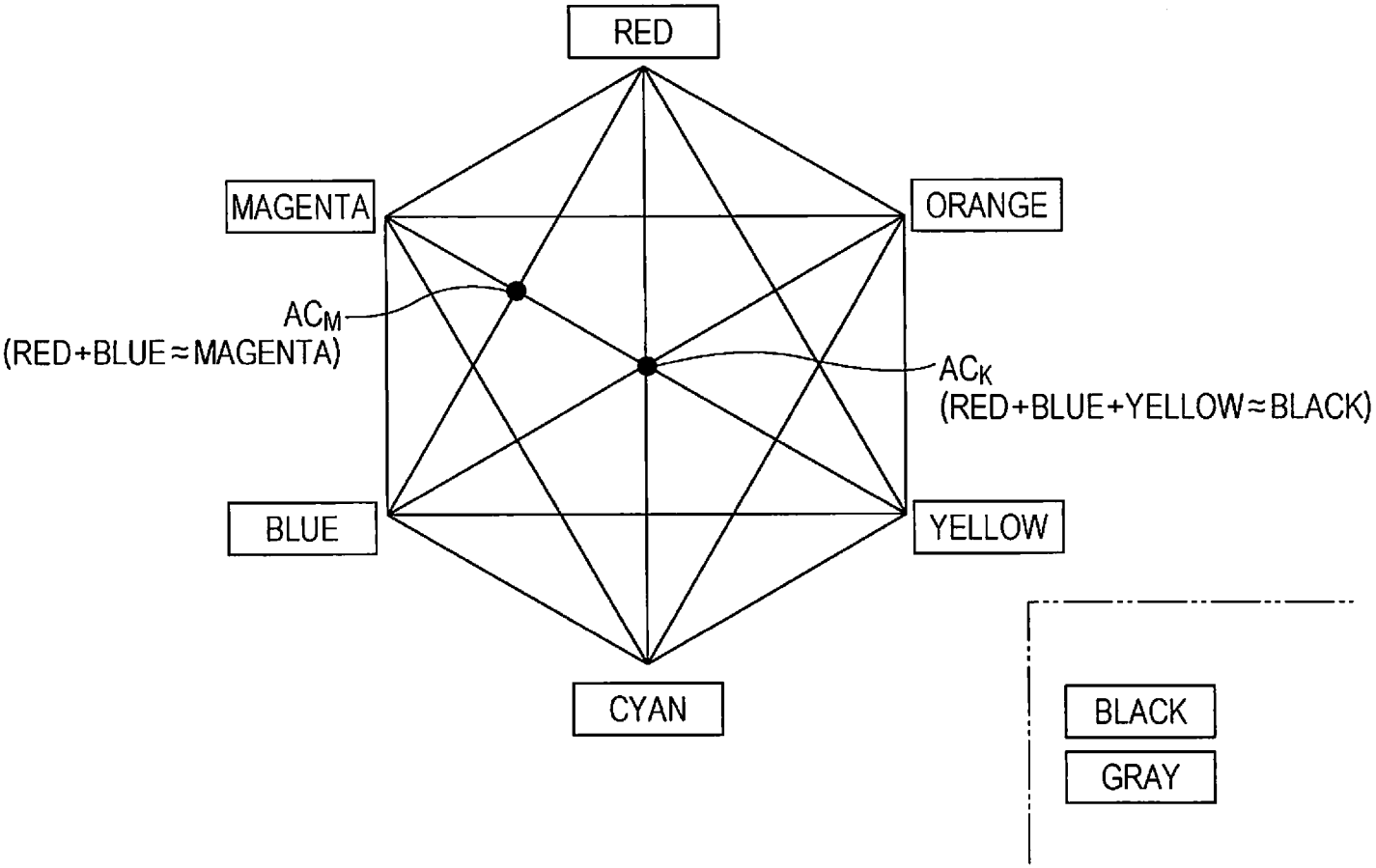
FIG. 15 illustrates an example of a calibration curve usable in the printing apparatus illustrated in FIG. 1.
Figure 16:
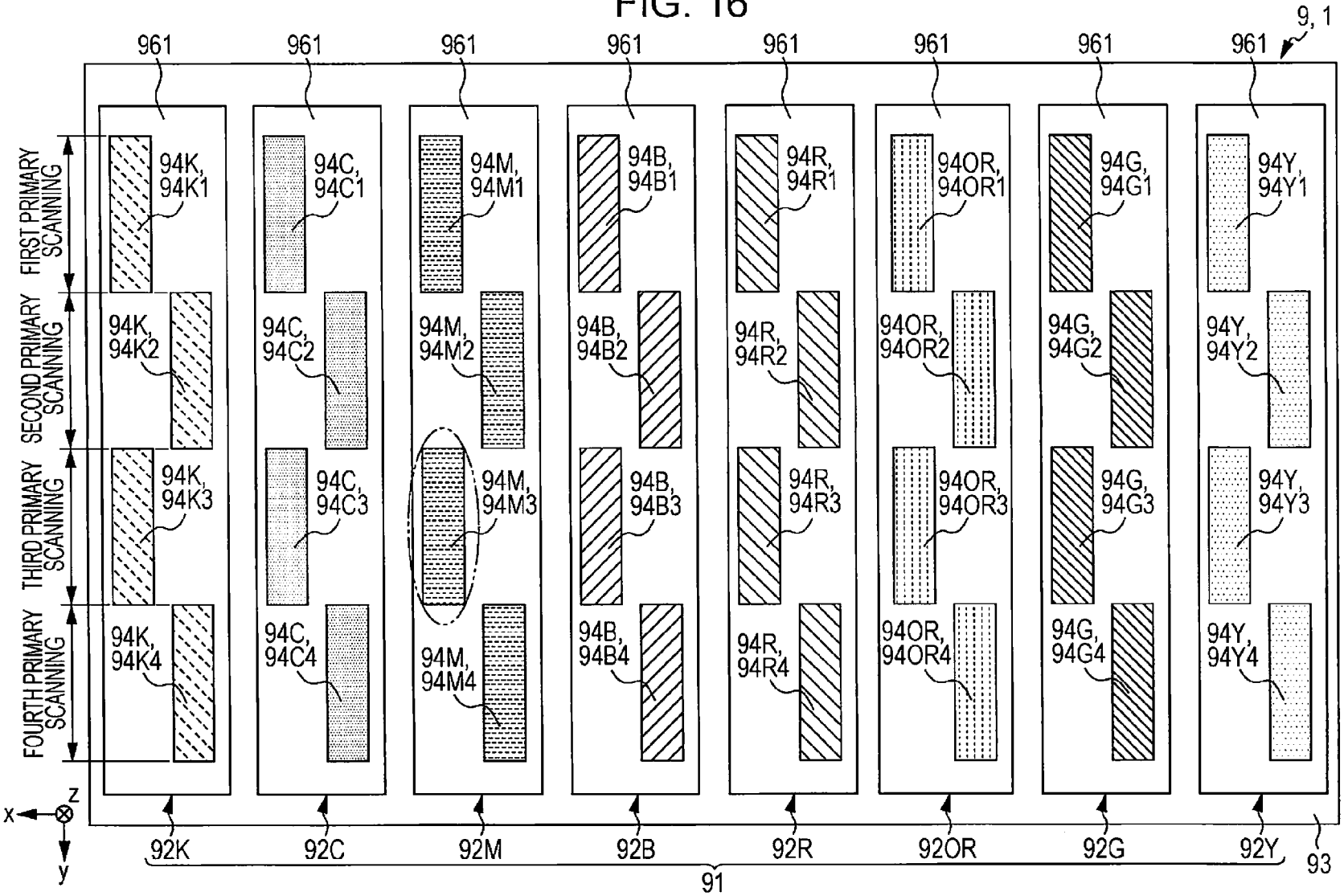
FIG. 16 is a drawing viewed from a direction indicated by an arrow XVI in FIG. 2.
Figure 17:
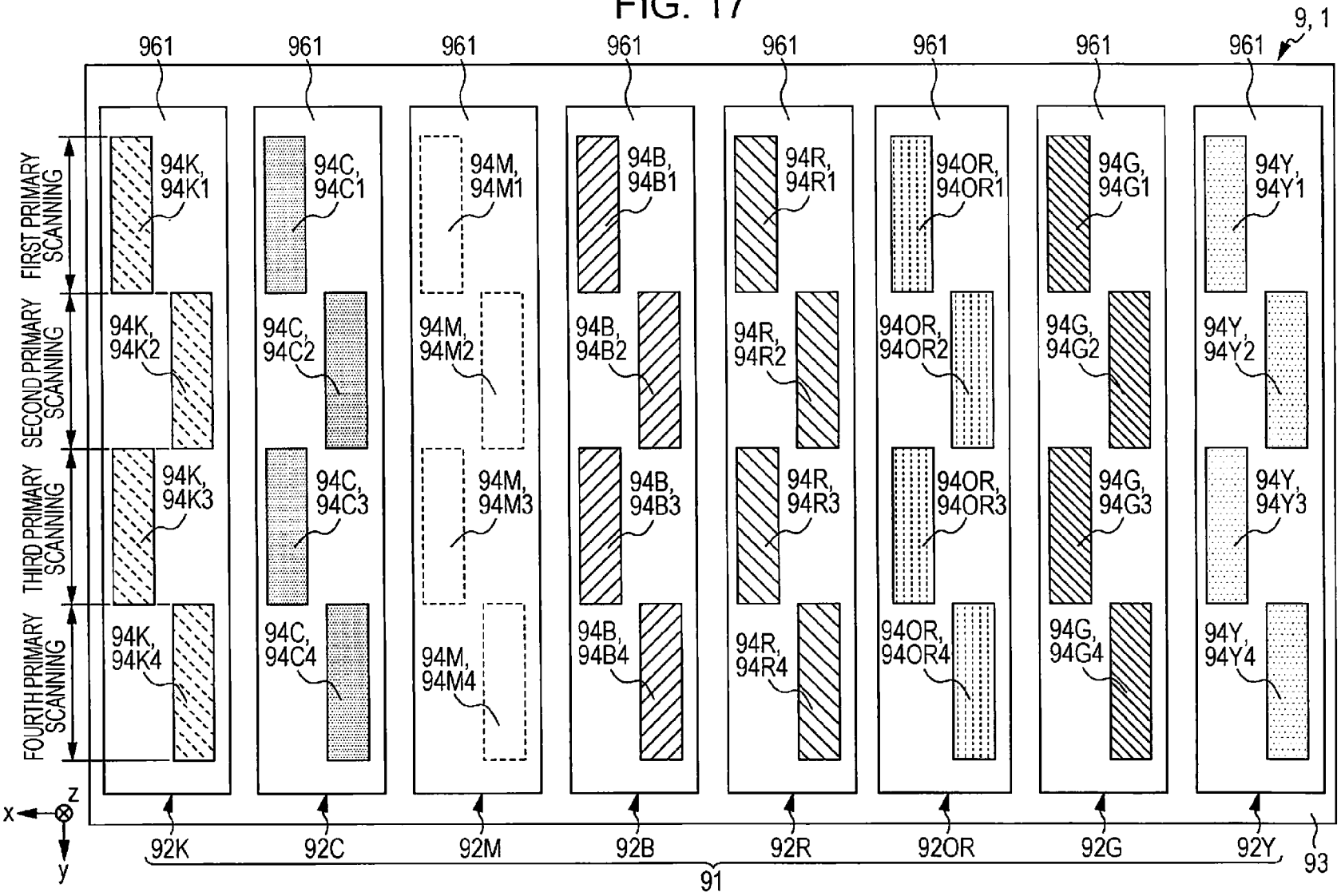
FIG. 17 is a drawing viewed from the direction indicated by the arrow XVII in FIG. 2 (a drawing illustrating a state of a head unit in a first mode).
Figure 18:
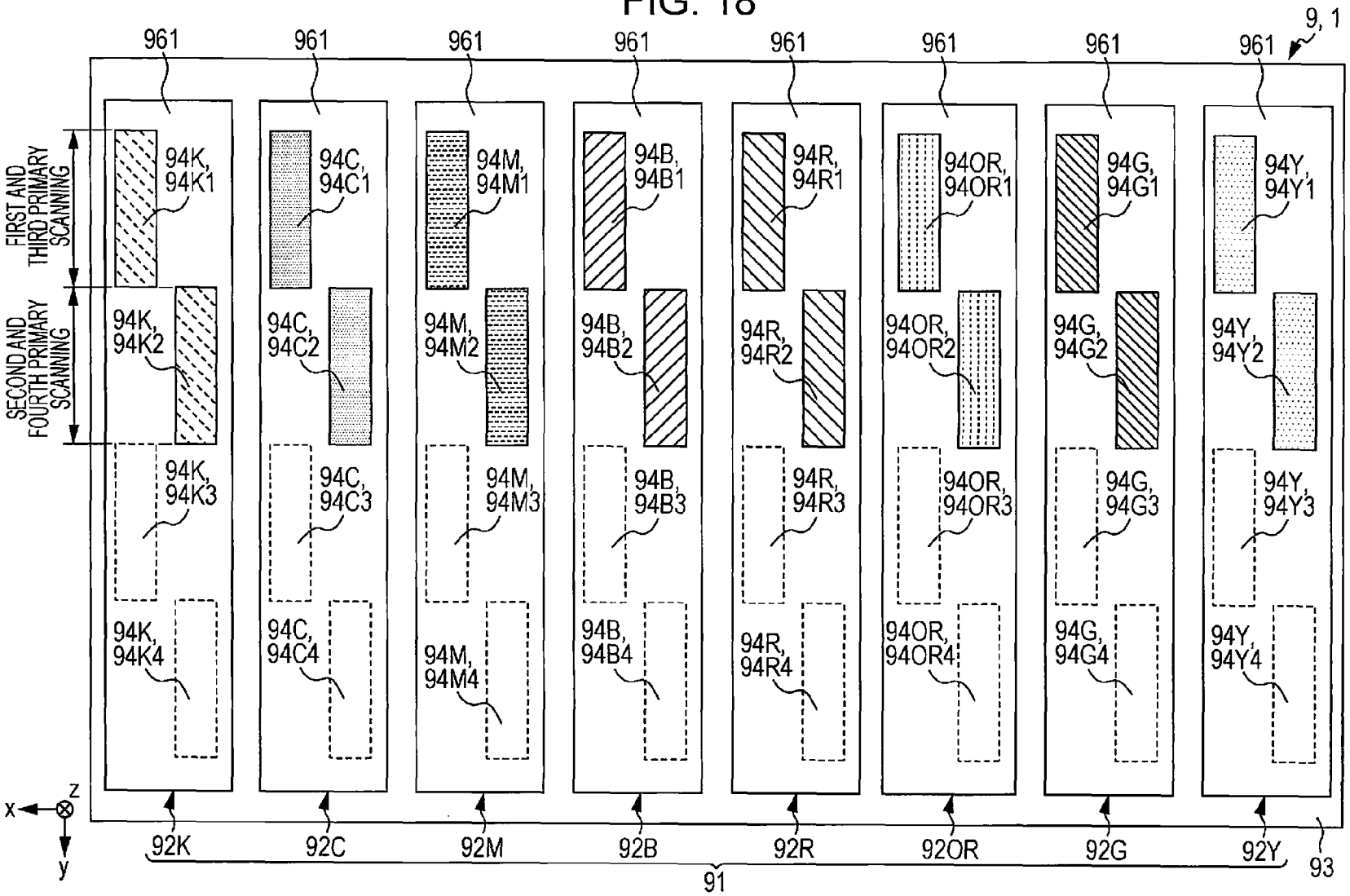
FIG. 18 is a drawing viewed from the direction indicated by the arrow XVIII in FIG. 2 (a drawing illustrating a state of the head unit in a second mode).

FIG. 1 is a plan view illustrating an embodiment of a printing apparatus of the invention. FIG. 2 is a side view of the printing apparatus illustrated in FIG. 1. FIG. 3 is a schematic cross-sectional view of a head unit provided on the printing apparatus illustrated in FIG. 1. FIG. 4 to FIG. 12 are side views of operating states of the printing apparatus in FIG. 1 illustrated in sequence. FIGS. 13A and 13B are drawings illustrating a relationship between a length of a nozzle row (see FIG. 13A) and an amount of movement of one stroke of secondary scanning (see FIG. 13B). FIG. 14 is a flowchart illustrating a control program of a control unit integrated in the printing apparatus illustrated in FIG. 1. FIG. 15 illustrates an example of a calibration curve usable in the printing apparatus illustrated in FIG. 1. FIG. 16 to FIG. 18 are drawings viewed in a direction indicated by an arrow XVI to XVIII in FIG. 2. In the following description, a vertical direction of FIG. 1 is expressed as "x-axis direction", a lateral direction thereof is expressed as "y-axis direction", and a direction perpendicular to the plane of FIG. 1 is expressed as "z-axis direction" for the sake of description. Coordinate axes in FIG. 2, FIG. 4 to FIG. 13B, and FIG. 16 to FIG. 18 correspond to coordinate axes in FIG. 1.

As illustrated in FIG. 1 and FIG. 2, a printing apparatus 1 includes a machine base 11, a transport mechanism (transport means) 12 configured to transport a work W as a recording medium, and a printing mechanism (printing means) 13 configured to apply printing on the work W.

The transport mechanism 12 includes a feeding apparatus 3 configured to feed a long work W wound up in a roll shape, a winding apparatus 4 configured to wind the printed work W, a work stage 5 disposed on the machine base 11 and configured to adsorb and set the supplied work W, a stage supporting apparatus (stage supporting unit) 20 configured to support the work stage 5, and a work retaining apparatus 30 provided on a downstream side of the work stage 5 in the y-axis direction and configured to fixedly clamp the work W.

In this embodiment, the x-axis direction is a direction of a plane on the work stage 5 orthogonal to a transport direction in which the work W is transported, the y-axis direction is a direction parallel to the transport direction, and the z-axis direction is a direction orthogonal to the x-axis direction and the y-axis direction.

The stage supporting apparatus 20 extends in the y-axis direction, and includes a Y-axis table 7 configured to feed the work W intermittently in the y-axis direction via the work stage 5, and a stage rotating mechanism 40 configured to rotate the work stage 5 about the z-axis.

The printing mechanism 13 includes a carriage unit 9 having a head unit 91 configured to perform recording by printing on the work W by discharging ink (liquid) therefrom, and an X-axis table 8 extended in the x-axis direction so as to straddle the Y-axis table 7 of the stage supporting apparatus 20 and configured to support the carriage unit 9 to be movable in the x-axis direction.

The printing apparatus 1 further includes a maintenance apparatus 50 including a sucking unit configured to forcedly drain ink from the head unit 91 and a wiping unit configured to wipe a nozzle surface, and a control apparatus 60 configured to control respective parts of the printing apparatus 1. The maintenance apparatus 50 is disposed in a maintenance area deviated in the x-axis direction from a printing area where the Y-axis table 7 and the X-axis table 8 intersects, and performs maintenance of the head unit 91 caused to face the maintenance area.

The printing apparatus 1 is capable of setting a printing area W1 on the work W and performs printing in the printing area W1 (see FIG. 13B).

In other words, the printing apparatus 1 adsorbs by the work stage 5 the work fed by the feeding apparatus 3 into a fixed state, then feeds the work W by the Y-axis table 7 intermittently in the y-axis direction via the work stage 5 (secondary scanning), and discharges ink from the head unit 91 to the printing area W1 of the work W in the fixed state while moving the carriage unit 9 to reciprocate in the x-axis direction (primary scanning). This operation is performed until printing in the printing area W1 is complete.

Configurations of the respective portions will be described.

The feeding apparatus 3 is disposed on an upstream side of the machine base 11 in a feeding direction (y-axis direction) of the work W. The feeding apparatus 3 includes a feeding reel (delivering roll) 31 on which the work W is wound up in a roll shape and configured to feed the work W, a feeding motor 32 configured to rotate the feeding reel 31 to feed the work W, and a feeding-side buffer mechanism 33 configured to bend the work W in the z-axis direction into a "V" shape and apply a light back tension to the work W.

As illustrated in FIG. 2, the feeding-side buffer mechanism 33 includes a feeding-side dancer roller 33*a* movable in the z-axis direction so as to apply a back tension constantly to the work W, feeding-side guide rollers 33*b* provided respectively on the upstream side and the downstream side of the feeding-side dancer roller 33*a*, and a pair of upper and lower feeding-side sensors 33*c* configured to detect the position of the feeding-side dancer roller 33*a* in the z-axis direction. The feeding-side guide rollers 33*b* on the upstream side are nip rollers.

Figure 5:
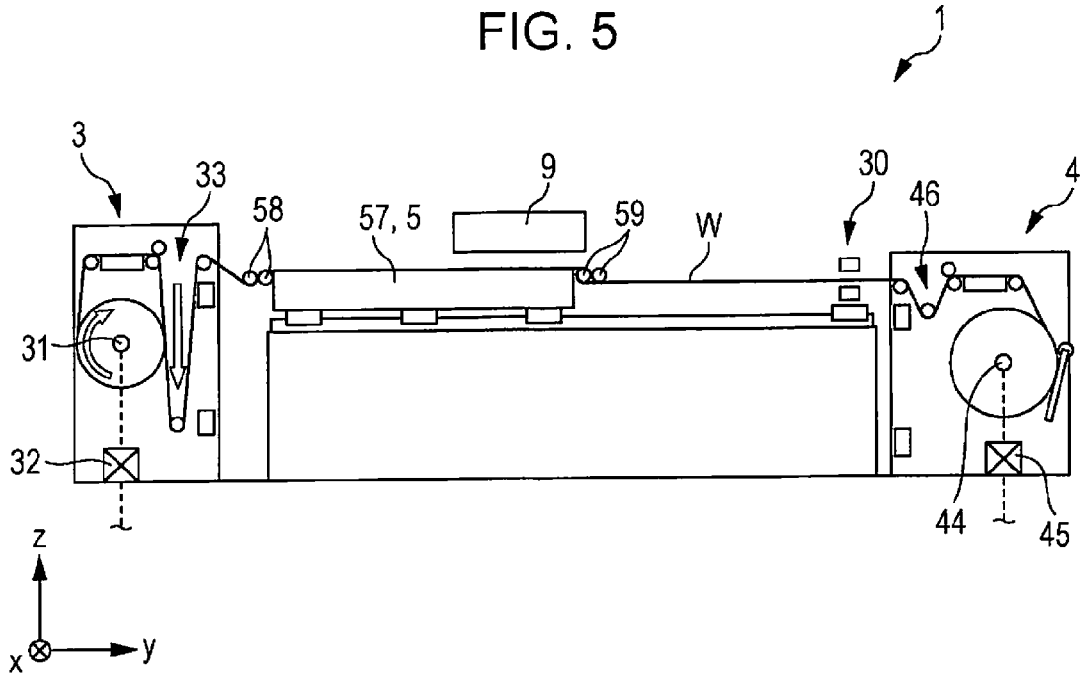
FIG. 5 is a side view of an operating state in the sequence of the printing apparatus illustrated in FIG. 1.
Figure 6:
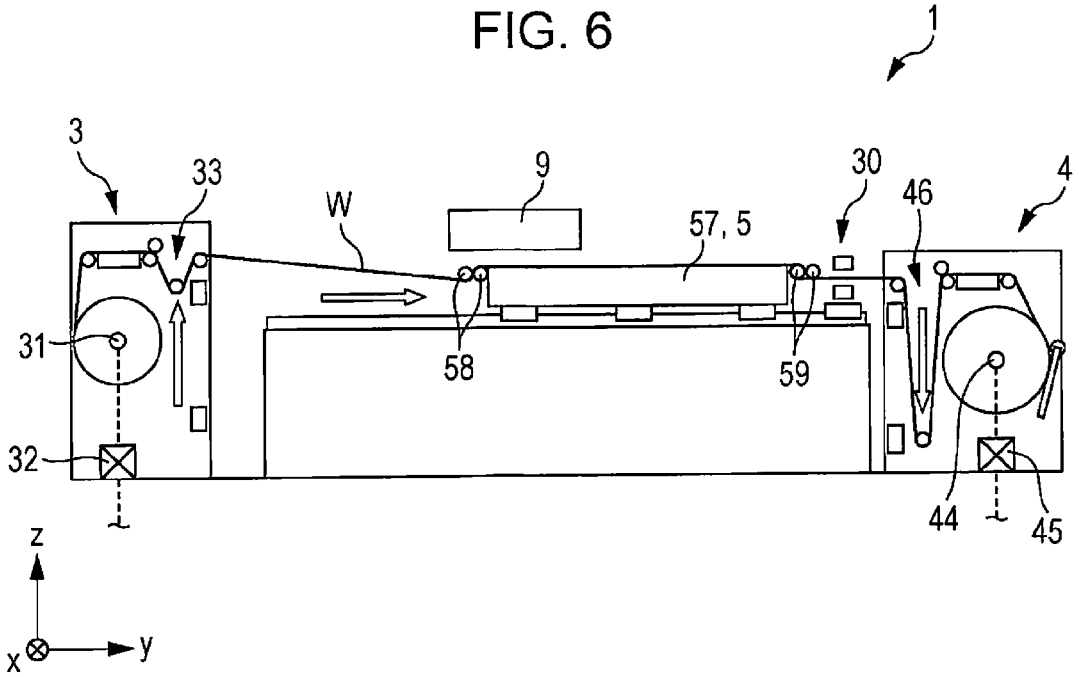
FIG. 6 is a side view of an operating state in the sequence of the printing apparatus illustrated in FIG. 1.

The length of the work W retained by the feeding-side buffer mechanism 33 is set to be a length longer than a distance of movement of the work stage 5 (see FIG. 5). In this embodiment, the feeding motor 32 is driven upon detection of the feeding-side sensor 33*c* on the upper limit side, and the feeding motor 32 is stopped upon detection of the feeding-side sensor 33*c* on the lower limit side so that the length of the work W can be maintained. Accordingly, the work W of a required amount can be fed. The amount of the work W is absorbed by the feeding-side buffer mechanism 33, so that winding of the work W again on the feeding reel 31 can be omitted when performing a recording operation a plurality of times on one printing area W1.

The work W which can be used here includes a thin film type having an ink absorption property and a thin film type having a non-ink-absorption property. The former type includes, for example, ink jet recording paper such as normal paper, high-quality paper, and gloss paper and, in addition, woven cloths. The latter type includes, for example, plastic films which are not subjected to a surface treatment for ink jet printing (that is, ink absorbing layer is not formed), base materials such as paper coated with plastic and those having the plastic film adhered thereto. The plastic is not specifically limited, and includes, for example, polyvinyl chloride, polyethylene terephthalate, polycarbonate, polystyrene, polyurethane, polyethylene, and polypropylene.

The winding apparatus 4 is disposed on the downstream side of the machine base 11 in a work W feeding direction (y-axis direction) with respect to the feeding apparatus 3. The winding apparatus 4 includes a winding reel (winding roll) 44 configured to wind the work W in a roll shape, a winding motor 45 configured to rotate the winding reel 44 to wind the work W, and a winding-side buffer mechanism 46 configured to bend the wound-up work W into a "V" shape in the z-axis direction and apply a light forward tension to the work W.

As illustrated in FIG. 2, the winding-side buffer mechanism 46 includes a winding-side dancer roller 46*a* capable of moving in the z-axis direction so as to apply the forward tension constantly to the work W, winding-side guide rollers 46*b* provided respectively on the upstream side and the downstream side of the winding-side dancer roller 46*a*, and a pair of upper and lower winding-side sensors 46*c* configured to detect the position of the winding-side dancer roller 46*a* in the z-axis direction. The winding-side guide rollers 46*b* on the downstream side are nip rollers.

The winding-side buffer mechanism 46 is configured to drive the winding motor 45 upon detection of the winding-side sensor 46*c* on the lower limit side so that the work W of a predetermined length can be maintained and to stop the winding motor 45 upon detection of the winding-side sensor 46*c* on the upper limit side in the same manner as the feeding-side buffer mechanism 33. Accordingly, a required amount of the work W can be wound up without being affected by a roll diameter of the winding reel 44. Accordingly, the amount of the work W fed to the downstream side can be absorbed by the winding-side buffer mechanism 46, and hence the fed work W can be supplied/removed without being wound up by the winding reel 44. In addition, the work W can be wound up by the winding reel 44 without applying an excessive tensile force to the work on the work stage 5.

The work stage 5 is disposed between the feeding apparatus 3 and the winding apparatus 4. The work stage 5 has a plurality of holes (not illustrated) formed on the surface thereof, and includes a stage body 57 configured to adsorb the work W fed from the feeding apparatus 3, infeed rollers 58 attached to an upstream end portion of the stage body 57 in the transport direction of the work W, and delivery rollers 59 attached to a downstream end portion of the stage body 57 in the transport direction of the work W. The plurality of holes formed in the stage body 57 communicate with a vacuum suction device and a compressed air supply device which are not illustrated in the drawing. When the vacuum suction device is operated, a fixed state in which the work W is adsorbed onto the stage body 57 via the holes is achieved. When, from the fixed state, the operation of the vacuum suction device is stopped and the compressed air supply device is operated, the work W is released from the stage body 57, that is, a cancellation state in which the fixed state is canceled is achieved.

The work stage 5 is moved by the Y-axis table 7 intermittently in the y-axis direction (from the upstream side to the downstream side) in a state in which the work W is adsorbed to the stage body 57. In this embodiment, since drawing is performed plurality of times in one printing area W1, when the work stage 5 has reached a downstream end position (print end position) where drawing corresponding to one printing area W1 ends, the work stage 5 is moved again to an upstream end position (print start position) by the Y-axis table 7.

The infeed rollers 58 and the delivery rollers 59 are each composed of freely rotatable nip rollers, and are arranged in the y-axis direction. The infeed rollers 58 and the delivery rollers 59 are each provided so that an upper portion thereof can be moved upward and downward between a descended position, which is a position substantially flush with an upper surface of the stage body 57, and an elevated position, which is a position moved slightly (approximately several mm) upward from the descended position. Elevating mechanisms for the infeed rollers 58 and the delivery rollers 59 are preferably composed of a cylinder (either pneumatic or hydraulic) or a motor and a rack and pinion and the like.

The work W is extended over the upper surface of the stage body 57 in a state of being clamped between the infeed rollers 58 and between the delivery rollers 59. By moving the infeed rollers 58 and the delivery rollers 59 downward to the descended position, the work (the printing area W1) is able to be adsorbed to the upper surface of the stage body 57 and retained and, in contrast, by canceling the adsorbed and retained state (stopping vacuum suction) and supplying compressed air between the work W and the stage body 57 to move the infeed rollers 58 and the delivery rollers 59 to the elevated position, the work W is slightly floated. Accordingly, removal or feeding of the work W from or to the upper surface of the stage body 57 is enabled without applying an excessive tensile force on the work W. Since the printing area W1 is separated (floated) from the work stage 5, the work W can be removed or fed without causing the work W to have a scratch or the like.

The infeed rollers 58 and the delivery rollers 59 at the descended position are in line in the y-axis direction and are substantially flush with the upper surface of the stage body 57. Therefore, flatness of the work W can be maintained not only in an area adsorbed and retained onto the stage body 57 but also from a position clamped by the infeed rollers 58 to the position clamped by the delivery rollers 59. In other words, the printing area W1 can be secured as large as possible. When moving the infeed rollers 58 and the delivery rollers 59 upward/downward, preferably, upward/downward movement of one of the infeed rollers 58 and the delivery rollers 59 is started, and then the upward/downward movement of the other one is started with delay. Accordingly, when those rollers are moved to the descended position, the work W can be brought into tight contact with the stage body 57 by pushing air between the work W and the stage body 57 out, so that the work W can be desirably and reliably adsorbed and retained.

The Y-axis table 7 is disposed on the machine base 11, and includes a pair of Y-axis guide rails 71 extending in the y-axis direction, and a motor-driven Y-axis slider 72 configured to support the work stage 5 so as to be slidable along the Y-axis guide rails 71. The Y-axis table 7 stops when the carriage unit 9 moves onward (or moves backward), and feeds the work W to the downstream side in the y-axis direction by an amount corresponding to a printing width. In other words, the Y-axis table 7 performs print scanning of the carriage unit 9, and then feeds the work stage 5 (work W) intermittently (return feed) by a distance corresponding to a printed width. A drive system thereof is preferably composed of a linear motor, a motor and a ball screw mechanism or the like.

The stage rotating mechanism 40 is composed of a motor and a plurality of gears integrated in the stage body 57. With the operation of the motor, a rotational force of the motor is transmitted to the stage body 57 via gears. Accordingly, the stage body 57 can rotate a predetermined angle about the z-axis.

The X-axis table 8 includes: a pair of X-axis guide rails 84 extending so as to straddle the machine base 11 in the x-axis direction, a bridge plate 85 on which the carriage unit 9 is hung, and a motor-driven X-axis slider 86 configured to support the bridge plate 85 to be slidable in the x-axis direction. The X-axis table 8 moves the head unit 91 as a whole reciprocally in the x-axis direction via the carriage unit 9 at the time of printing and causes the head unit 91 to face the maintenance apparatus 50. A drive system thereof is preferably composed of a linear motor, a motor and ball screw mechanism, a mechanism including a belt and a pulley, or the like.

In the printing apparatus 1, the X-axis table 8 and the Y-axis table 7 constitute a moving unit configured to move the carriage unit 9 and the work W relatively to each other. In other words, in the printing apparatus 1, the X-axis table 8 and the Y-axis table 7 constitute the moving unit configured to perform primary scanning that moves the carriage unit 9 in the x-axis direction (one direction) and secondary scanning that moves the work W in the y-axis direction which intersects a primary scanning direction.

As illustrated in FIG. 16 to FIG. 18, the carriage unit 9 includes the head unit 91 and a carriage body 93 configured to retain the head unit 91.

The carriage body 93 is provided vertically on the bridge plate 85. The carriage body 93 includes a mechanism integrated therein and configured to rotate the head unit 91 about the z-axis. The carriage body 93 includes a pair of UV lamps 95 mounted on both sides thereof in the x-axis direction via the head unit 91.

Ink used in this embodiment is so-called UV cured ink (UV ink). By illumination of the pair of UV lamps 95, UV cured ink landed on the work W can be cured and fixed.

The head unit 91 is in charge of printing by applying ink to the work W.

As illustrated in FIG. 16 (same applies to FIG. 17 and FIG. 18), the head unit 91 includes a droplet discharge head 92K, a droplet discharge head 92C, a droplet discharge head 92M, a droplet discharge head 92B, a droplet discharge head 92R, droplet discharge head 92OR, a droplet discharge head 92G, and a droplet discharge head 92Y disposed in sequence along the x-axis direction.

The droplet discharge head 92K is configured to discharge ink having black (K) color as liquid droplets and includes four nozzle rows 94K. The droplet discharge head 92C is configured to discharge ink having cyan (C) color as liquid droplets and includes four nozzle rows 94C. The droplet discharge head 92M is configured to discharge ink having Magenta (M) color as liquid droplets and includes four nozzle rows 94M. The droplet discharge head 92B is configured to discharge ink having blue (B) color as liquid droplets and includes four nozzle rows 94B. The droplet discharge head 92R is configured to discharge ink having red (R) color as liquid droplets and includes four nozzle rows 94R. The droplet discharge head 92OR is configured to discharge ink having orange (OR) color as liquid droplets and includes four nozzle rows 94OR. The droplet discharge head 92G is configured to discharge ink having gray (G) color as liquid droplets and includes four nozzle rows 94G. The droplet discharge head 92Y is configured to discharge ink having yellow (Y) color as liquid droplets and includes four nozzle rows 94Y. In this configuration, a multicolor printing (color printing) using eight colors (three or more colors) is enabled.

The nozzle rows 94K, 94C, 94M, 94B, 94R, 94OR, 94G, and 94Y are simply referred to as "nozzle rows 94" in the case where colors of ink to be discharged need not to be discriminated.

As illustrated in FIG. 13A, each of the nozzle rows 94 is a portion including, for example, 360 nozzles 941 that discharge ink droplets of the same color arranged linearly along the y-axis direction. In this configuration, the ink droplets can be applied over a wide range on the work W by one stroke of primary scanning.

The droplet discharge head 92K, the droplet discharge head 92C, the droplet discharge head 92M, the droplet discharge head 92B, the droplet discharge head 92R, the droplet discharge head 92OR, the droplet discharge head 92G, and the droplet discharge head 92Y have the same configuration except that the color of the ink to be discharged is different. Therefore, the configuration of the droplet discharge head 92M will be described as a representative.

As described above, the droplet discharge head 92M has four nozzle rows 94M. Two of the nozzle rows 94M out of the four nozzle rows 94M are arranged apart from each other in the y-axis direction and remaining two nozzle rows 94M are also arranged apart from each other in the y-axis direction, and the former nozzle rows 94M and the latter nozzle rows 94M are adjacent to each other in the x-axis direction. The latter nozzle rows 94M are arranged at a position shifted by half the distance between centers of the former nozzle rows 94M in the y-axis direction. In other words, the array of the four nozzle rows 94M are zigzag array. Accordingly, the droplet discharge head 92M can be used as that having 1440 nozzles.

Owing to synergistic effect of a combination of the arrangement of the nozzle rows 94 that discharge droplets of the same color along a secondary scanning direction and the arrangement of the nozzle rows 94 that discharge droplets of different colors (droplet discharge heads 92K to 92Y) in a primary scanning direction, ink droplets having a plurality of colors can be applied at a time over a wide range on the work W when the head unit 91 is moved in a direction orthogonal to the direction of arrangement of the nozzles 941 with respect to the work W.

Hereinafter, the four nozzle rows 94 of the head unit 91 may be referred to as "nozzle row **94*1", "nozzle row 94*2", "nozzle row 94*3", and "nozzle row 94*4" in sequence from the top in FIG. 16 to FIG. 18**. The mark "*" may be any of "K", "C", "M", "B", "R", "OR", "G", and "Y" which represent the colors of ink.

As illustrated in FIGS. 13A and 13B, an entire length y1 in the direction in which the nozzles 941 in the four nozzle rows 94 are arranged is almost the same as an amount of movement y2 of one stroke of secondary scanning of the work W. Ideally, the distance y2 corresponds to a value of y1 with the distance between adjacent nozzles 941 added thereto.

For example, when performing printing in the printing area W1 of the work W, the primary scanning is performed first (see FIG. 16). In this primary scanning, any one of the droplet discharge heads 92K, 92C, 92M, 92B, 92R, 92OR, 92G, and 92Y is used. Next, the secondary scanning is performed once. From then onward, by repeating the primary scanning and the secondary scanning, a printing operation for the first time in the printing area W1 is ended as described later. Subsequently, a printing operation in the printing area W1 for the second time and so forth can be performed in the same manner as the first printing operation.

As illustrated in FIG. 3, the droplet discharge head 92M includes a nozzle plate 961, a cavity substrate 962, an oscillating plate 963, and a laminated piezoelectric actuator 965 having a plurality of piezoelectric elements 964*a* laminated one on top of another. The droplet discharge head 92M includes the cavity substrate 962, the oscillating plate 963, and the piezoelectric actuator 965 arranged corresponding to the respective nozzle rows 94M.

The cavity substrate 962 is formed into a predetermined shape as illustrated in FIG. 3 and, accordingly, a cavity (pressure chamber) 966 and a reservoir 967 communicating therewith is formed. The cavity 966 is filled with ink as liquid and the internal pressure is increased/decreased by a displacement of the oscillating plate 963. The reservoir 967 is connected to an ink cartridge 70 via an ink supply tube 968.

The nozzle plate 961 includes the nozzles 941 for each of the nozzle rows 94M. The nozzles 941 communicate with the cavity 966, and are capable of discharging ink as liquid droplets by increasing/decreasing the pressure in the cavity 966.

The piezoelectric actuator 965 is configured to displace the oscillating plate 963. The piezoelectric actuator 965 includes comb-teeth-shaped first electrode 964*b* and second electrode 964*c*, and the piezoelectric elements 964*a* disposed alternately with the respective comb-teeth of the first electrode 964*b* and the second electrode 964*c*. The piezoelectric actuator 965 is joined, on one end side thereof, to the oscillating plate 963 via an intermediate layer 969. The piezoelectric actuator 965 having such a configuration uses a mode of expanding/contracting in a vertical direction upon reception of a drive signal from a drive signal source applied between the first electrode 964*b* and the second electrode 964*c* as illustrated in FIG. 3. The piezoelectric actuator 965 provides a relatively large drive force because the piezoelectric elements 964*a* are laminated.

Therefore, in the piezoelectric actuator 965, when the drive signal is applied, the oscillating plate 963 is displaced, and the pressure in the cavity 966 is changed, so that ink droplets are discharged from the nozzles 941.

As illustrated in FIG. 1 and FIG. 2, the work retaining apparatus 30 includes a pair of clampers 301 facing an upper surface and a lower surface of the work W respectively, a clamping drive mechanism 302 configured to move the pair of clampers 301 inward, a motor driven clamper slider 303 configured to support the clampers 301 and clamping drive mechanism 302 to be slidable along the above-described pair of Y-axis guide rails 71. The work retaining apparatus 30 has a home position in the vicinity of the winding apparatus 4 (the downstream end in the y-axis direction) and is provided so as to be movable on the downstream side of the work stage 5 in the y-axis direction.

The clampers 301 are formed to have a width larger than the width of the work W in the x-axis direction and are disposed so as to face both front and rear surfaces of the work W. The pair of clampers 301 have surfaces that oppose the work W and that are formed of a resilient material such as rubber, so that no relative slippage occurs and no damage is applied to the work W when driving the clamping drive mechanism 302 and clamping the work W from the vertical direction.

The clamping drive mechanism 302 couples the pair of clampers 301 at both end portions thereof, and moves (moves inward) the pair of clampers 301 so as to clamp the work W in the vertical direction from above and below by placing the work W at the center. In this manner, by moving the pair of clampers 301 inward, the work W is prevented from moving in the vertical direction in a transporting route from the feeding apparatus 3 to the winding apparatus 4 and an unnecessary tension is prevented from being applied to the work W. Accordingly, damage to the work W (including expansion of the work W) and generation of an error in amount of movement when the work W clamped by the work retaining apparatus 30 is moved can be prevented. The clamping drive mechanism 302 is preferably composed of a cylinder (either pneumatic or hydraulic) or a motor and a rack and pinion and the like.

The clamper slider 303 moves the clampers 301 and the clamping drive mechanism 302 reciprocally in the y-axis direction by using a drive system composed of the motor and a belt mechanism. The work retaining apparatus 30 clamps the work W by the pair of clampers 301 and moves the work W to the downstream side in the y-axis direction by the clamper slider 303, so that the work W is delivered to the winding apparatus 4. The drive system of the clamper slider 303 may be composed of a linear motor, a motor and ball screw mechanism, and other cylinders (either pneumatic or hydraulic).

An operating state of the printing apparatus 1, that is, a printing method using the printing apparatus 1 will be described below with reference to FIG. 4 to FIG. 12.

Figure 4:
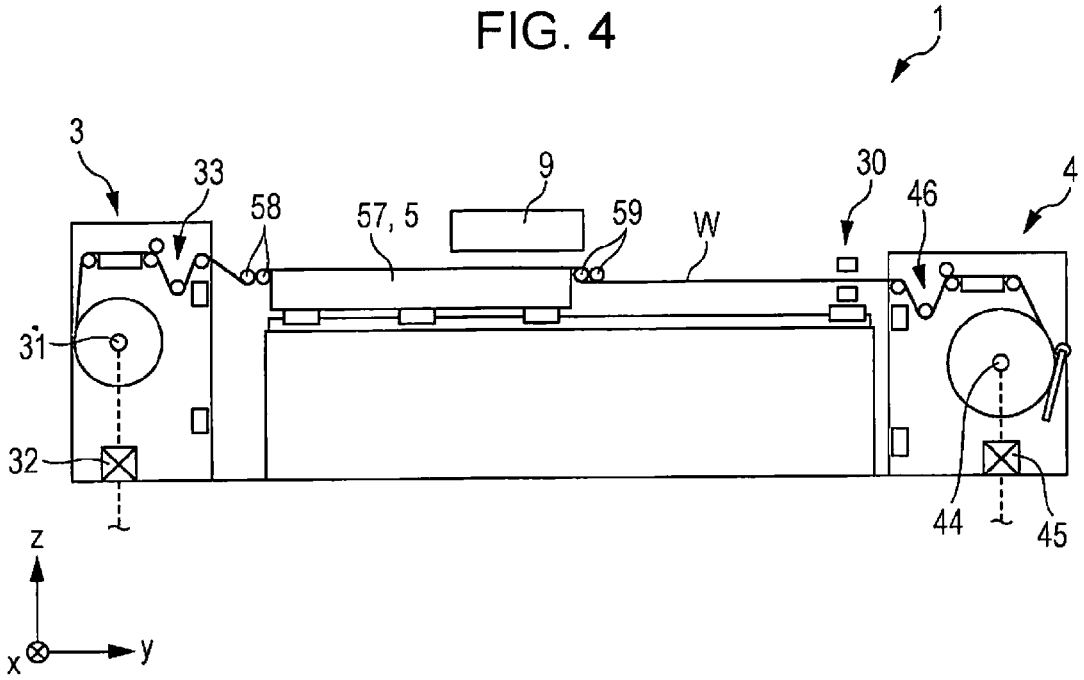
FIG. 4 is a side view of an operating state in a sequence of the printing apparatus illustrated in FIG. 1.

[1] First, as illustrated in FIG. 4, the work W having a roll shape is introduced onto the feeding reel 31, a fed distal end portion is passed between the infeed rollers 58 and between the delivery rollers 59 and is connected to the winding reel 44. Then, the infeed rollers 58 and the delivery rollers 59 are moved to the descended position, and the work stage 5 is moved to the print start position. The printing area W1 of the work W is adsorbed and retained on the work stage 5 (stage body 57) in a fixed state.

[2] Next, as illustrated in FIG. 5, the feeding motor 32 is driven, the work having substantially the same length as the distance of movement of the work stage 5 is fed, and the fed work W is retained by the feeding-side buffer mechanism 33.

[3] Next, ink droplets are discharged from the head unit 91 to perform a predetermined printing (print scanning) while causing the carriage unit 9 to scan in the x-axis direction the printing area W1 adsorbed to and retained by the work stage 5. Subsequently, the work stage 5 (work W) is moved to the downstream side in the y-axis direction by an amount corresponding to the printing width in the print scanning (return feed). The print scanning (primary scanning) and the return feed (secondary scanning) are repeated by a plurality of times to perform printing to an amount corresponding to the printing area W1. When the printing operation of an amount corresponding to the printing area W1 is ended, the work stage 5 reaches a print end position (see FIG. 6).

The work W retained by the feeding-side buffer mechanism 33 is pulled out to the downstream side in the y-axis direction in association with the movement of the work stage 5 and, simultaneously, the work W on the downstream side in the y-axis direction of the work stage 5 is fed to the winding-side buffer mechanism 46 and is retained. During this operation, the feeding motor 32 and the winding motor 45 are not driven.

Figure 7:
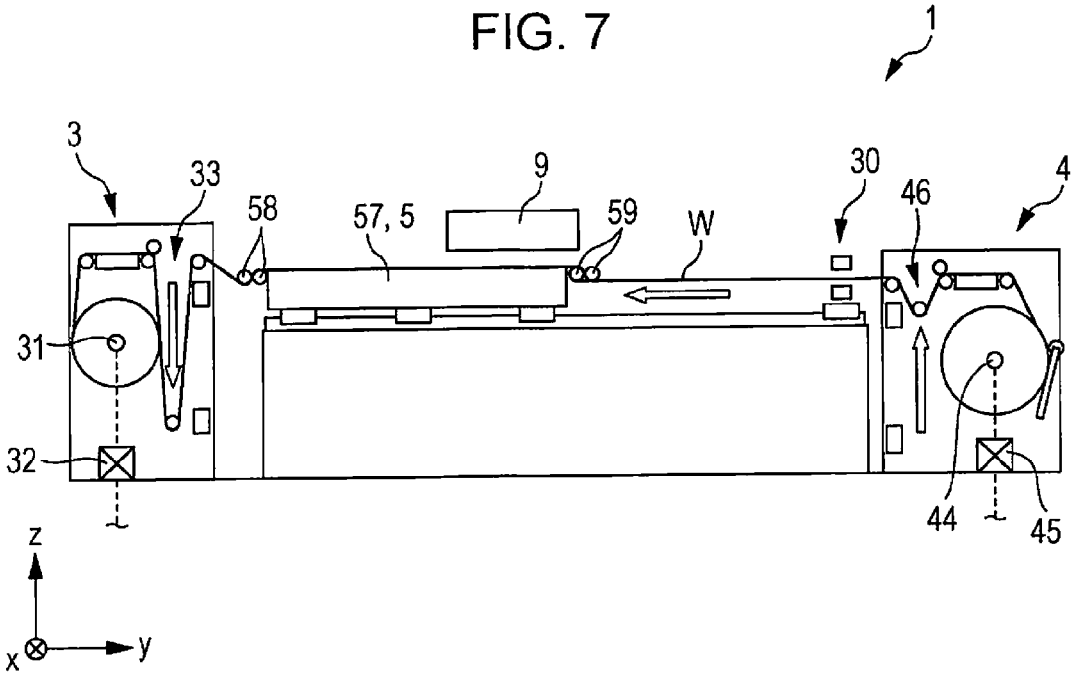
FIG. 7 is a side view of an operating state in the sequence of the printing apparatus illustrated in FIG. 1.

[4] Next, as illustrated in FIG. 7, the work stage 5 facing the print end position is moved to return to the print start position in order to perform the second recording operation in the printing area W1. When the return movement is performed, the work W retained by the winding-side buffer mechanism 46 is pulled out to the upstream side in the y-axis direction in association with the movement of the work stage 5 and, simultaneously, the work W on the upstream side in the y-axis direction of the work stage 5 is fed to the feeding-side buffer mechanism 33 and is retained again. In this manner, the work W fed to the upstream side can be absorbed by the feeding-side buffer mechanism 33, the work W does not have to be wound up by the feeding reel 31 again. This configuration is specifically effective in the case where the printing operation is performed by a plurality of times as in this embodiment. In this embodiment, the printing operation is performed by a plurality of times in the printing area W1. However, the number of the printing operation may be only once.

Figure 8:
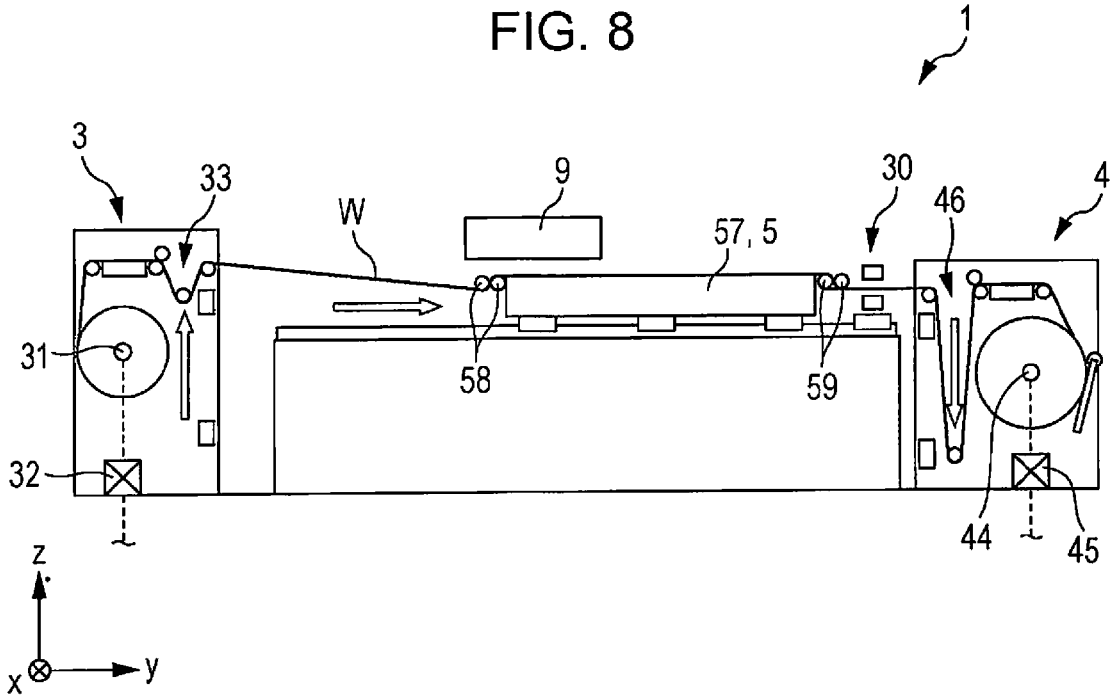
FIG. 8 is a side view of an operating state in the sequence of the printing apparatus illustrated in FIG. 1.

[5] Next, as illustrated in FIG. 8, the second printing operation is performed in the printing area W1 where the first printing operation has been ended. Since this operation is the same as the operation[3], description thereof is not repeated.

Figure 9:
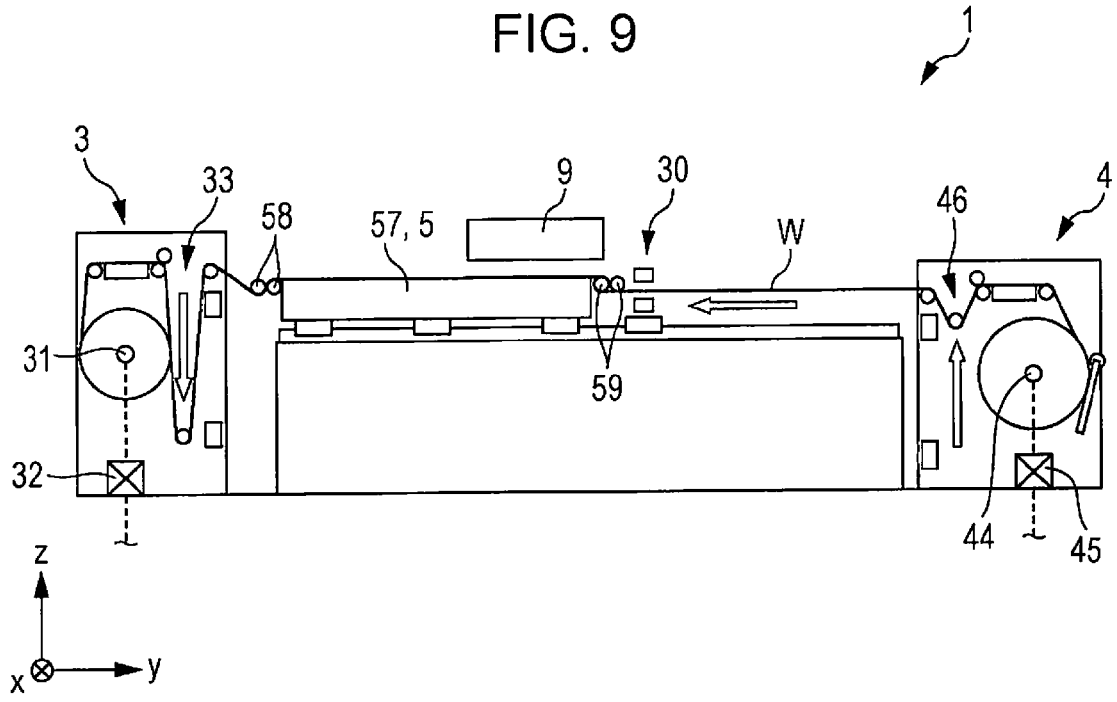
FIG. 9 is a side view of an operating state in the sequence of the printing apparatus illustrated in FIG. 1.

[6] As illustrated in FIG. 9, the second recording operation is ended, and the printing area W1 facing the print end position is moved to return to the print start position again. At the time of this return movement, the work retaining apparatus 30 is moved toward the print start position. In other words, the work retaining apparatus 30 is located in the vicinity of the downstream side of the delivery rollers 59 of the work stage 5 moved to the print start position.

Figure 10:
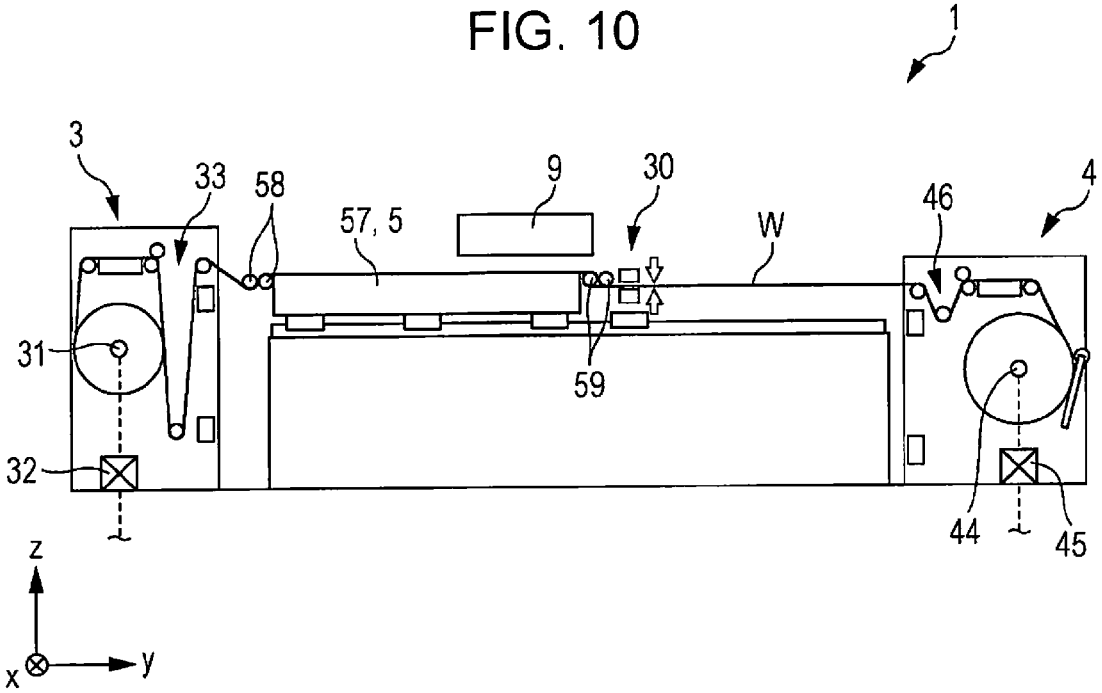
FIG. 10 is a side view of an operating state in the sequence of the printing apparatus illustrated in FIG. 1.

[7] Next, as illustrated in FIG. 10, the work retaining apparatus 30 is driven to clamp the work W.

Figure 11:
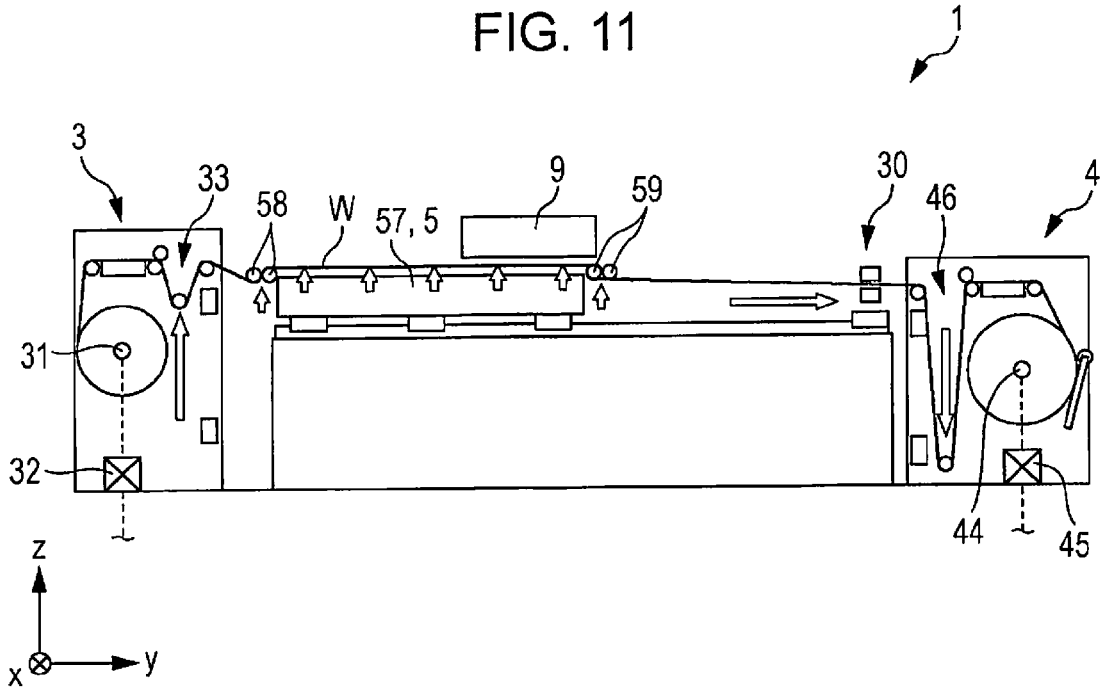
FIG. 11 is a side view of an operating state in the sequence of the printing apparatus illustrated in FIG. 1.

[8] Next, as illustrated in FIG. 11, adsorption of the work W (printing area W1) onto the work stage 5 is canceled (vacuum suction is stopped) to achieve the cancellation state, and compressed air is supplied to move the infeed rollers 58 and the delivery rollers 59 to the elevated position. Subsequently, the work stage 5 is maintained to be unmovable and the work retaining apparatus 30 is moved to the downstream side. At this time, the printed printing area W1 on the work stage 5 is pulled out to the downstream side in the y-axis direction and, correspondingly, a portion of the work W corresponding to the pulled out amount is absorbed (retained) by the winding-side buffer mechanism 46. On the other hand, the work W retained by the feeding-side buffer mechanism 33 is pulled out and faces the work stage 5. Part of the work W facing the work stage 5 corresponds to the next printing area W1.

Figure 12:
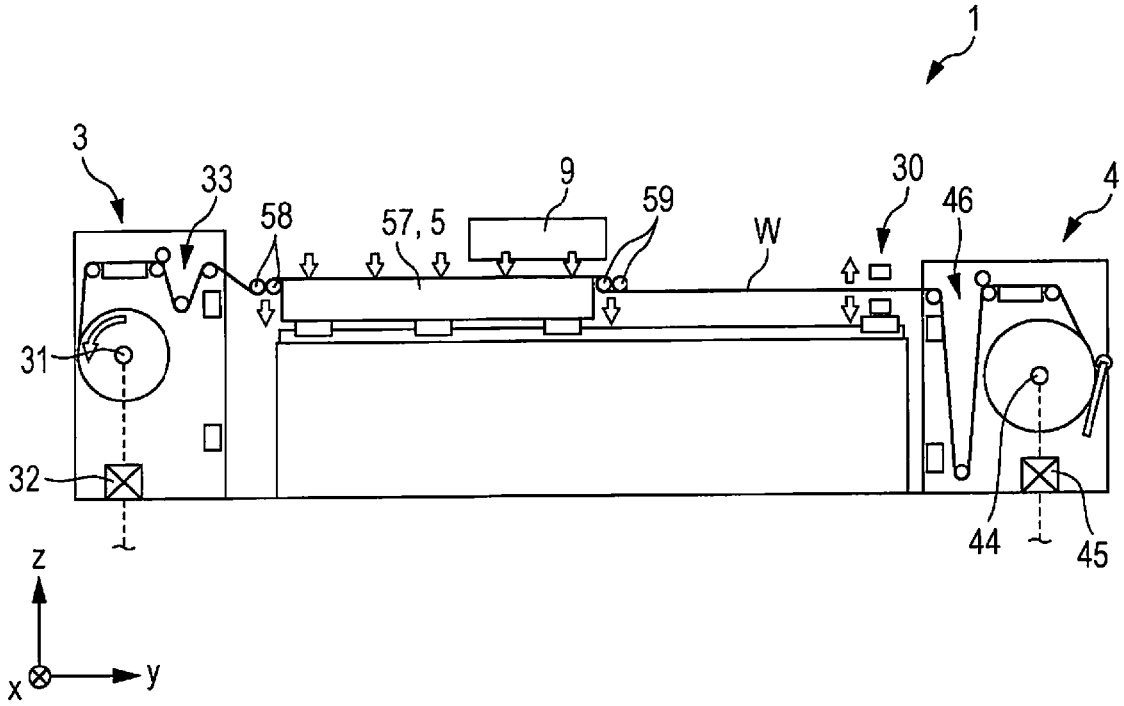
FIG. 12 is a side view of an operating state in the sequence of the printing apparatus illustrated in FIG. 1.

[9] Next, as illustrated in FIG. 12, the infeed rollers 58 and the delivery rollers 59 are moved to the descended position, and a unprinted trailing printing area W1 facing the work stage 5 is adsorbed and retained into the fixed state, and then the clamping state of the work W by the work retaining apparatus 30 is canceled. In this embodiment, immediately before or immediately after the adsorption of the work W to the work stage 5, the feeding motor 32 is driven in a winding direction to adjust the tension applied to the work W on the work stage 5.

[10] The control apparatus 60 drives the winding motor 45 to wind up the work W retained in the winding-side buffer mechanism 46, and as described above, drives the feeding motor 32 to feed the work W by substantially the same amount as the distance of the movement of the work stage 5 to the feeding-side buffer mechanism 33 (see FIG. 5). Accordingly, printing in the next printing area W1 is enabled.

The printing apparatus 1 may be subjected to an abnormal discharge (no discharge) of ink droplets such that ink droplets are not discharged from the nozzles 941 of the head unit 91 when needed, which is a so-called dot-missing phenomenon, due to, for example, clogging (drying), out of ink, generation of air bubbles, adherence of dust or dirt. In this case, the abnormal discharge may be detected by an abnormal discharge detecting unit (abnormal discharge detecting means) 80 integrated in the control apparatus 60. However, the printing apparatus 1 is not operated, that is, the printing operation is not continued until the abnormal discharge is canceled, and the operation remains stopped.

Control operation described below is effective to allow continuation of printing even though the abnormal discharge occurs.

The abnormal discharge detecting unit 80 will be described first.

The abnormal discharge detecting unit 80 is configured to detect residual oscillations of each oscillating plate 963 of the head unit 91 and detects occurrence of the abnormal discharge in accordance with a result of detection as described in JP-A-2005-305992, for example. The printing apparatus 1 is capable of detecting the abnormal discharge reliably in such a simple manner as detecting the residual oscillations.

When a drive signal is supplied to the piezoelectric actuator 965 illustrated in FIG. 3, the oscillating plate 963 bends and the capacity of the cavity 966 is increased and contracted. At this time, part of the ink filling the cavity 966 is discharged as ink droplets from the nozzles 941 which communicate with the cavity 966 by the pressure generated in the cavity 966. With a series of operation of the oscillating plate 963, the oscillating plate 963 causes free oscillations at a natural resonance frequency determined by an acoustic resistance caused by the nozzles 941, the ink supply port, or viscosities of ink, inertance depending on an ink weight in an ink flow channel, and compliance of the oscillating plate 963. The free oscillations correspond to the residual oscillations.

Here, if ink is normally discharged and the acoustic resistance, the inertance, and the compliance are not changed, the residual oscillations of the oscillating plate 963 form a constant waveform. However, in the case where the dot-missing phenomenon occurs due to the failure of the ink discharge, the waveform of the residual oscillations of the oscillating plate 963 is different from that in the normal state. In this manner, the abnormal discharge can be detected from a difference in residual oscillations of the oscillating plate 963.

In the printing apparatus 1, the head unit 91 can take two modes in the case where the abnormal discharge detecting unit 80 detects an abnormal discharge when printing, so that printing can be performed by selecting one of the two modes for printing (See FIG. 14).

The first mode is a mode in which printing is performed by using remaining nozzles 941 except a nozzle 941 that has been detected to have the abnormal discharge by the abnormal discharge detecting unit 80 and nozzles 941 that discharge liquid droplets having the same color as liquid droplets discharged from the nozzle 941 detected to have the abnormal discharge. Hereinafter, this mode is referred to as the "first mode".

For example, as illustrated in FIG. 16, it is assumed that an abnormal discharge is detected at least at one nozzle 941 of a nozzle row 94M3 surrounded by double-dashed chain line in FIG. 16 from among the four nozzle rows 94M of the droplet discharge head 92M included in the head unit 91. In this case, in the first mode, use of all the nozzles 941 belonging to (included in) the nozzle row 94M3 is stopped as illustrated in FIG. 17. In addition, use of all the nozzles 941 belonging to the nozzle rows 94M1, 94M2, and 94M4 that discharge droplets having the same color as the nozzles 941 in the nozzle row 94M3 is stopped. Consequently, the remaining droplet discharge heads 92K, 92C, 92B, 92R, 92OR, 92G, and 92Y except the droplet discharge head 92M are used in printing.

Here, in the case where "magenta (M)" is required in printing, discharge of "magenta (M)" ink from the droplet discharge head 92M is stopped and hence the printing missing the "magenta (M)" seems to performed as a result thereof. However, an approximate color approximates to the magenta (M) can be reproduced by using ink from at least one of the droplet discharge heads 92K, 92C, 92B, 92R, 92OR, 92G, and 92Y. Accordingly, missing the "magenta (M)" is prevented or suppressed in an image formed on the work W by printing in the first mode, that is, the "magenta (M)" is supplemented by the approximate color.

Reproduction of the approximate color in this embodiment is achieved by using, for example, a calibration curve illustrated in FIG. 15. The calibration curve is stored in the control apparatus 60 in advance.

The calibration curve illustrated in FIG. 15 is created on a basis of a CIE xy chromaticity diagram in a CIE color coordinate system. Accordingly, reproduction of the approximate color can be performed as rapidly and accurately as possible. For example, in order to obtain a color $AC_M$ approximate to "magenta (M)" as illustrated in FIG. 15, the ratio (amount of discharge) of "red (R)" ink and "blue (B)" ink on the work W is adjusted to obtain the approximate color $AC_M$. For example, in order to obtain a color $AC_K$ approximate to "black (K)", the ratio (amount of discharge) of "red (R)" ink, "blue (B)" ink, and "yellow (Y)" ink on the work W is adjusted to obtain the approximate color $AC_K$. In the same manner, respective approximate colors of "red (R)", "blue (B)", "cyan (C)", "yellow (Y)", "orange (OR)", and "gray (G)" can be obtained. In this manner, in the first mode, the missing color may be reproduced on the work W by using at least two colors of ink.

As illustrated in FIG. 17, in the primary scanning, the droplet discharge head 92R and the droplet discharge head 92B reproduce the color to be produced by the droplet discharge head 92M.

As the calibration curve to be used for reproducing an approximate color, for example, a graph, a table, or an expression may be used in addition to that illustrated in FIG. 15.

The second mode is a mode in which printing is performed by using remaining nozzle rows 94 except the nozzle row 94 including a nozzle 941 that has been detected to have the abnormal discharge by the abnormal discharge detecting unit 80 and nozzle rows 94 that are located in the same x-axis direction (primary scanning direction) as the nozzle row 94 detected to have the abnormal discharge. Hereinafter, this mode is referred to as the "second mode".

In the same manner as described above, for example, as illustrated in FIG. 16, it is assumed that an abnormal discharge is detected at least at one nozzle 941 of a nozzle row 94M3 surrounded by double-dashed chain line in FIG. 16 from among the four nozzle rows 94M of the droplet discharge head 92M included in the head unit 91. In this case, in the second mode, use of all the nozzles 941 belonging to the nozzle row 94M3 is stopped as illustrated in FIG. 18. In addition, use of all the nozzles 941 belonging to the nozzle rows 94K3, 94C3, 94B3, 94R3, 94OR3, 94G3, and 94Y3 located in the same x-axis direction (primary scanning direction) as the nozzle row 94M3 is also stopped.

In addition, in the second mode, use of all the nozzles 941 of the nozzle rows 94 located on the side where the number of the nozzle rows 94 is smaller out of the plurality of nozzle rows 94 located on both sides in the y-axis direction (secondary scanning direction) of the nozzle rows 94K3 to 94Y3, use of which is stopped, as a boundary. That is, in the configuration illustrated in FIG. 18, use of all the nozzles 941 belonging to the nozzle rows 94K4 to 94Y4 on the lower side of the nozzle rows 94K3 to 94Y3 in FIG. 18 is stopped.

Consequently, as illustrated in FIG. 18, in the printing of the second mode, the nozzle rows 94 including a large number of the nozzle rows 94 with respect to the boundary of the nozzle rows 94K3 to 94Y3, the use of which is stopped, that is, nozzle rows 94K1 to 94Y1 and nozzle rows 94K2 to 94Y2 on the upper side of the nozzle rows 94K3 to 94Y3 in FIG. 18 are used. Accordingly, even though use of some of the nozzle rows 94 is stopped, the larger number of nozzle rows 94 may be continuously used.

In the primary scanning, printing on the work W is performed by using two nozzle rows including the nozzle rows 94K1 to 94Y1 and the nozzle rows 94K2 to 94Y2. The amount of movement of one stroke of movement in the secondary scanning of the work is adjusted depending on the length of the used nozzle rows (the number of nozzles), and in this case, is adjusted to be approximately half the amount of movement y2 during the normal printing or in the first mode in which four nozzle rows are employed.

An even number of the nozzle rows 94 are disposed in the y-axis direction in this embodiment. However, the invention is not limited thereto, and an odd number of the nozzle rows 94 may be disposed. In the nozzle rows 94 disposed by an odd number, in the case where use of the nozzle rows 94 in the middle is stopped due to an abnormal discharge, the nozzle rows 94 to be used may be those on any side of the nozzle rows 94 in the middle as a boundary.

When the first mode and the second mode are compared, the first mode tends to be capable of reducing the number of the nozzle rows 94 use of which is stopped. In contrast, unlike the first mode, in the second mode, all the colors of inks may be used basically without reproducing the approximate color. Therefore, in the printing apparatus 1 of the invention, preferably, the first mode is selected in the case where the speed of the printing process has priority than the quality of the printed image. In contrast, in the case where the quality of the printed image has higher priority than the speed of the printing process, the second mode is preferably selected.

A control program for continuing printing by switching the mode to the first mode or the second mode even though the abnormal discharge occurs will be described on the basis of the flowchart in FIG. 14.

The head unit 91 is operated (Step S101). Accordingly, the printing operation is performed and printing in the printing area W1 of the work W can be performed.

Next, the abnormal discharge detecting unit 80 is operated during the printing operation, and whether or not the abnormal discharge occurs in the head unit 91 is determined (Step S102).

If it is determined that the abnormal discharge is detected in Step S102, whether or not the first mode is executed is determined (Step S103). In the case where it is set to select the first mode in the printing apparatus 1 in advance, it is determined in Step S103 that the first mode is executed, and then the first mode is executed (Step S104).

In the case where it is set to select the second mode in the printing apparatus 1 in advance, it is determined in Step S103 that the first mode is not executed, and then if it is determined to execute the second mode (Step S105), the second mode is executed (Step S106).

In the case where the control apparatus 60 determines that other abnormalities than the abnormal discharge have occurred, it is determined in Step S105 that the second mode is not executed, and the operation of the head unit 91 is stopped (Step S107). Here, "other abnormalities" include, for example, formation of wrinkles on the work W.

As described above, in the printing apparatus 1, even in the case where the abnormal discharge occurs in the head unit 91 (nozzles 941) during printing, the printing can be continued stable while preventing lowering of the speed of a printing process by selecting the first mode. In the case where the second mode is selected, the printing can be continued stable while maintaining the image quality of the printing.

In addition, timing of replacement of the head unit 91 having the abnormal discharge may be postponed as much as possible, and hence a MTBF (Mean Time Between Failure) may be elongated.

Although the printing apparatus and the printing method of the invention have been described in conjunction with the illustrated embodiment, the invention is not limited thereto, and respective components may be replaced by arbitrary configurations which can demonstrate the same functions. Arbitrary component may be added.

Although the head units discharge inks having different colors from each other in the embodiment described above, the number of types of colors is not limited to eight and, for example, three colors, four colors, five colors, six colors, seven colors or nine colors, or more are also applicable.

Although the number of the nozzle rows included in each of the droplet discharge heads which constitute the head unit is four in the embodiment described above. However, the invention is not limited thereto and, one, two three, or five or more, for example, are also applicable.

Although the abnormal discharge detecting unit of the embodiment described above is configured to detect the occurrence of the abnormal discharge in accordance with the result of detection of the residual oscillations, the invention is not limited thereto, and a configuration in which waste discharge of ink, for example, is performed from the respective nozzles, and the occurrence of the abnormal discharge is detected depending on the result is also applicable.

In the control program in the case where the abnormal discharge is detected, the second mode may be omitted.

The entire disclosure of Japanese Patent Application No. 2014-235897, filed Nov. 20, 2014 is expressly incorporated by reference herein.

What is claimed is:

1. A printing apparatus configured to perform printing on a recording medium comprising:

a head unit including a plurality of droplet discharge heads each of which has a plurality of nozzles, the droplet discharge heads being configured to discharge liquids having different colors from each other as droplets onto the recording medium; and an abnormal discharge detecting unit configured to detect an abnormal discharge nozzle that has an abnormal discharge of the droplets, the head unit being configured to take at least one mode of performing the printing in response to the abnormal discharge detecting unit detecting the abnormal discharge nozzle, the head unit being configured to, while taking the at least one mode, stop using the abnormal discharge nozzle and all nozzles which are arranged in the head unit and are configured to discharge droplets having the same color as droplets discharged by the abnormal discharge nozzle, and use remaining nozzles in the head unit except the abnormal discharge nozzle and the all of the nozzles which are arranged in the head unit and are configured to discharge the droplets having the same color as the droplets discharged by the abnormal discharge nozzle.

2. The printing apparatus according to claim 1, wherein the head unit is configured to perform multicolor printing with three or more colors and reproduce a color approximate to a color of droplets discharged by the abnormal discharge nozzle with droplets discharged by the remaining nozzles.

3. The printing apparatus according to claim 2, wherein a calibration curve for reproducing the approximate color is stored in advance.

4. The printing apparatus according to claim 1, further comprising a moving unit configured to alternately perform a primary scanning that moves the head unit in a primary scanning direction and a secondary scanning that moves the recording medium in a secondary scanning direction intersecting the primary scanning direction, wherein each of the droplet discharge heads has a plurality of nozzle rows including the nozzles arranged linearly along the secondary scanning direction, and the nozzle rows that discharge droplets of the same color are arranged along the secondary scanning direction and the droplet discharge heads are aligned so that the nozzle rows that discharge droplets of different colors are arranged in the primary scanning direction.

5. The printing apparatus according to claim 4, wherein a first mode is the at least one mode, the head unit is configured to further take a second mode in which, in response to the abnormal discharge detecting unit detecting the abnormal discharge nozzle, the head unit is configured to perform the printing by stopping a first nozzle row including the abnormal discharge nozzle and at least one nozzle row aligning in the primary scanning direction relative to the first nozzle row, and by using remaining nozzle rows except the first nozzle row including the abnormal discharge nozzle and except the at least one nozzle row aligning in the primary scanning direction relative to the first nozzle row, and the head unit is configured to select the first mode or the second mode.

6. The printing apparatus according to claim 5, wherein the first mode is selected in the case where the speed of the printing process has higher priority than the quality of the printed image.

7. The printing apparatus according to claim 5, wherein in the second mode, by using as a boundary including the abnormal discharge nozzle and the nozzle rows located in the same primary scanning direction as the nozzle row, the printing is performed with a plurality of the nozzle rows located on one of the both sides of the boundary in the secondary scanning direction, which has a larger number of the nozzle rows.

8. The printing apparatus according to claim 4, wherein the respective droplet discharge heads have the plurality of nozzle rows arranged in a zigzag pattern.

9. The printing apparatus according to claim 1, wherein the head unit includes an oscillating plate and a cavity filled with liquid, having an interior pressure increased/decreased by a displacement of the oscillating plate, and communicating with the respective nozzles, and is configured to discharge liquid droplets by the increase/decrease of the internal pressure, and the abnormal discharge detecting unit is configured to detect occurrence of the abnormal discharge in accordance with a result of detection of residual oscillations of the oscillating plate.

10. A printing method, comprising:

performing printing using a printing apparatus including a head unit having a plurality of droplet discharge heads each of which has a plurality of nozzles, and an abnormal discharge detecting unit configured to detect an abnormal discharge nozzle that has an abnormal discharge of the droplets, the droplet discharge heads being configured to discharge liquids having different colors from each other as droplets onto the recording medium, the performing of the printing including taking at least one mode of performing the printing in response to the abnormal discharge detecting unit detecting the abnormal discharge nozzle, the performing of the printing during the taking of the at least one mode including stopping using the abnormal discharge nozzle and all nozzles which are arranged in the head unit and configured to discharge droplets having the same color as droplets discharged by the abnormal discharge nozzle, and using remaining nozzles in the head unit except the abnormal discharge nozzle and the all of the nozzles which are arranged in the head unit and are configured to discharge the droplets having the same color as the droplets discharged by the abnormal discharge nozzle.

* * * * *